US007748797B2

(12) United States Patent
Cleveland et al.

(10) Patent No.: US 7,748,797 B2
(45) Date of Patent: Jul. 6, 2010

(54) STACKABLE BLOW MOLDED CABINET

(75) Inventors: Terri P. Cleveland, Holley, NY (US); Richard J. Rhinewald, Macedon, NY (US); Douglas O. Nichol, Walworth, NY (US); David Lewis, Penfield, NY (US); David A. Nowicky, Fairport, NY (US); Philip B. Race, Macedon, NY (US); Douglas E. Shaffer, Victor, NY (US); Kelvin H. Wildman, Honeoye Falls, NY (US); Peter F. Lynch, Skaneateles, NY (US); Scott W. Osiecki, Skaneateles, NY (US); Todd B. Abernethy, Skaneateles, NY (US)

(73) Assignee: John D. Brush & Co., Inc., Rochester, NY (US)

( * ) Notice: Subject to any disclaimer, the term of this patent is extended or adjusted under 35 U.S.C. 154(b) by 609 days.

(21) Appl. No.: 10/554,177

(22) PCT Filed: Apr. 23, 2004

(86) PCT No.: PCT/US2004/012555

§ 371 (c)(1),
(2), (4) Date: Apr. 27, 2007

(87) PCT Pub. No.: WO2004/093602

PCT Pub. Date: Nov. 4, 2004

(65) Prior Publication Data

US 2007/0252490 A1 Nov. 1, 2007

Related U.S. Application Data

(60) Provisional application No. 60/464,699, filed on Apr. 23, 2003.

(51) Int. Cl.
*A47B 47/00* (2006.01)

(52) U.S. Cl. ..... 312/257.1; 312/108

(58) Field of Classification Search ..... 312/107, 312/108, 111, 257.1, 198, 409, 215, 265.5, 312/265.6, 330.1, 334.1, 334.7, 350, 351
See application file for complete search history.

(56) References Cited

U.S. PATENT DOCUMENTS 1,222,451 A * 4/1917 Ohnstrand ..... 312/348.4

(Continued)

FOREIGN PATENT DOCUMENTS

BE 670 023 A 1/1966

(Continued)

OTHER PUBLICATIONS

European Patent Office, Supplementary European Search Report for Application No. 04750540.9-2313 PCT/US2004012555, Munich Germany, May 19, 2008.

*Primary Examiner*—James O Hansen
(74) *Attorney, Agent, or Firm*—Woods Oviatt Gilman LLP

(57) ABSTRACT

A multi-drawer file cabinet having an upper cabinet that may be stacked on top of a lower file cabinet is provided. The lower cabinet includes a top surface having a peripheral edge with a first perimeter. The upper cabinet includes a base with a sidewall. The sidewall has a peripheral edge with a second perimeter. The second perimeter is larger than the first perimeter so that the sidewall fits around the peripheral edge of the top surface of the first cabinet. The cabinets include an extendable drawer assembly having a pair of slide members slidably positioned between a pair of outer tracks formed in a casing and tracks formed in a drawer frame. Furthermore, a locking assembly is associated with a recess in the casing and a ledge of a drawer head to allow the drawer assembly to remain in a locked position even if the cabinet sustains fire damage.

23 Claims, 30 Drawing Sheets

U.S. PATENT DOCUMENTS

| | | | | | |
|---|---|---|---|---|---|
| 1,318,919 | A | * | 10/1919 | Probst | 312/334.1 |
| 1,352,002 | A | * | 9/1920 | Jones | 312/348.2 |
| 3,179,480 | A | * | 4/1965 | Brinker | 312/348.4 |
| 3,572,874 | A | | 3/1971 | Hassel | |
| 3,918,781 | A | | 11/1975 | Paris | |
| 4,681,381 | A | | 7/1987 | Sevey | |
| 4,976,753 | A | * | 12/1990 | Huang | 96/58 |
| 5,399,005 | A | | 3/1995 | Schafer | |
| 5,681,102 | A | * | 10/1997 | Forsgren | 312/334.1 |
| 5,816,674 | A | | 10/1998 | Manos et al. | |
| 5,931,548 | A | | 8/1999 | Bischoff | |
| 6,193,340 | B1 | | 2/2001 | Schenker et al. | |
| 6,416,145 | B1 | * | 7/2002 | Singh | 312/334.1 |

FOREIGN PATENT DOCUMENTS

| | | | |
|---|---|---|---|
| FR | 2 223 948 | A | 10/1974 |
| GB | 695 913 | A | 8/1953 |

* cited by examiner

STACKABLE BLOW MOLDED CABINET

CROSS-REFERENCE TO RELATED APPLICATIONS

This application claims the benefit of U.S. Provisional Application No. 60/464,699, filed on Apr. 23, 2003.

STATEMENT REGARDING FEDERALLY SPONSORED RESEARCH OR DEVELOPMENT

Not applicable.

BACKGROUND OF THE INVENTION

The present invention relates to a stackable vertical file cabinet. In particular, the present invention relates to a stackable vertical file cabinet having fully extendable drawers. More particularly, the invention relates to a fire resistant stackable vertical file cabinet having fully extendable drawers and a locking mechanism that is capable of remaining in a locked position even if the file cabinet is damaged by fire.

Vertical file cabinets typically include a plurality of individual cabinet housings which open at the front so as to receive a plurality of file drawers therein in a vertically stacked arrangement. Such cabinets are well known and typically use fasteners such as screws or other connection methods to assemble the individual cabinet housings to one another to form a vertical cabinet assembly.

However, existing vertical file cabinets have a number of drawbacks and deficiencies. For instance, the use of screws or similar fasteners to secure each file cabinet to one another to form a vertical file cabinet can be difficult and time consuming. In addition, the use of screws or similar fasteners makes it difficult and inconvenient to rearrange or customize the configuration of the cabinets to suit the needs of a user.

Existing vertical file cabinets also include drawers that are slidably positioned within the drawer housing by guide tracks that run on rollers or ball bearings. Also, the drawer assembly itself is made up of a number of parts that are assembled through the use of various tools and fasteners. The use of rollers and ball bearings and the need to use tools and fasteners to assemble the drawer assembly increases manufacturing time and cost.

Additionally, locking mechanisms used on file cabinets have a tendency to lose their ability to secure the file cabinet when exposed to fire. In particular, exposing the lock to increased temperatures causes the lock components to either melt or lose their structural integrity so that the cabinet drawer may be opened without regard to the locking mechanism.

Accordingly, there exists a need for a multi-drawer file cabinet system that allows for files cabinets to be securely and easily stacked upon one another without additional fastening members, while allowing for the file cabinets to be easily re-arranged to suit the needs of a user. In addition, there is a need for a drawer assembly that minimizes the use of tools and fasteners to reduce manufacturing time and cost. Further, there is a need for a file cabinet locking mechanism that remains functional even after being exposed to elevated temperatures. The present invention fills these needs as well as other needs.

BRIEF SUMMARY OF THE INVENTION

In order to overcome the above stated problems and limitations there is provided a multi-drawer fire-resistant file cabinet having an upper cabinet that may be stacked on top of a lower file cabinet.

In general, the lower cabinet may include a top surface having a peripheral edge with a first perimeter. The upper cabinet includes a base with a sidewall. The sidewall has a peripheral edge with a second perimeter. The second perimeter is larger than the first perimeter so that the sidewall fits around the peripheral edge of the top surface of the first cabinet.

In addition, the sidewall of the base includes a top edge, wherein the distance between the top edge and the peripheral edge of the sidewall is equal to the distance between the peripheral edge of the top surface of the first cabinet and the edge of the drawer opening. A bumper or washer may be positioned between the base and the top surface of the lower-cabinet to prevent damage to the cabinets. An accessory holder may also be positioned on top of the upper cabinet.

Further, the upper and lower cabinets may include an interior casing, an upper shell portion and a rear shell portion. At least one of the upper shell portion and the rear shell portion has a tab extending from a bottom edge thereof, and the base has at least one slot defined therein for accepting the tab to secure the upper shell portion and rear shell portion to the base.

Each of the cabinets may also include an extendable drawer assembly having a pair of slide members slidably positioned between a pair of outer tracks formed in an interior casing and a pair of tracks formed in a drawer frame. The outer tracks formed in the interior casing may each include an outer groove and an inner groove, wherein at least one of the slide members have a stop extending therefrom that extends into the inner groove formed in the interior casing. A pair of drawer tracks may extend from the drawer frame and have slots defined therein, wherein each of the slide members have slide tabs that extend into the slots formed in the drawer tracks. Moreover, the drawer assembly may further include a clip having a locking tab that is positioned within a lock slot formed in the slide tabs.

Furthermore, the drawer assembly may include a drawer head, an escutcheon plate, a drawer front, and a locking mechanism, wherein the drawer head and the escutcheon plate are coupled with the drawer front, and the locking mechanism is positioned within the escutcheon plate. The locking mechanism may include a cam having an attaching leg, a flat portion, and a locking leg. The drawer head includes a ledge positioned below at least a portion of the flat portion of the cam, and the interior casing has a recess formed therein for receiving the locking leg of the cam to allow the drawer assembly to remain in a locked position even if the cabinet sustains fire damage.

Additional objects, advantages and novel features of the present invention will be set forth in part in the description which follows, and will in part become apparent to those in the practice of the invention, when considered with the attached figures.

BRIEF DESCRIPTION OF THE SEVERAL VIEWS OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
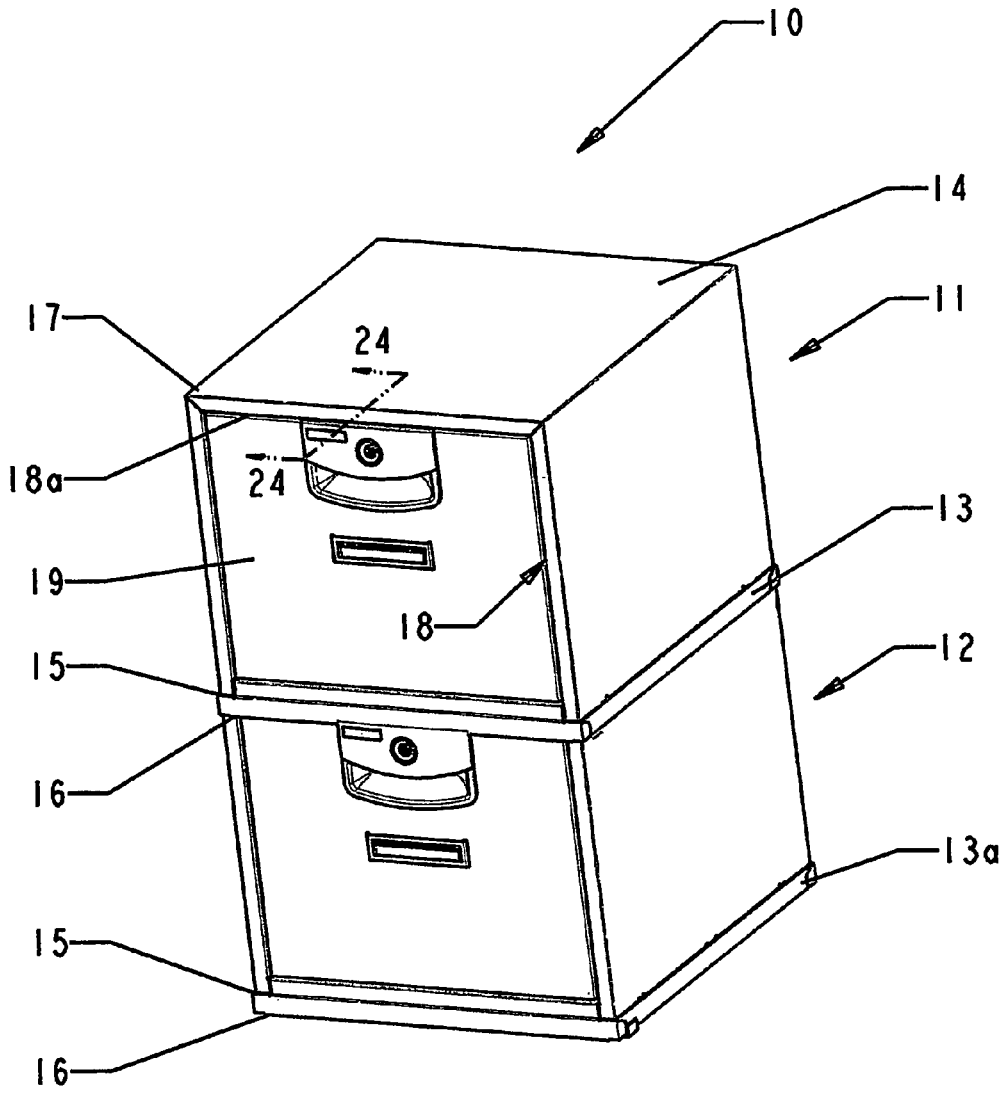
FIG. 1 is a perspective view of a multi-drawer file cabinet having upper and lower file cabinets in accordance with the present invention.

Referring now to the drawings in detail, and initially to FIG. 1, reference numeral 10 generally designates a multi-drawer file cabinet. In general, file cabinet 10 may include an upper file cabinet 11 and a lower file cabinet 12. With additional reference to FIG. 2A, both upper file cabinet 11 and lower file cabinet 12 may include a base 13 having a sidewall 13*a* and a lower surface 13*c*. The peripheral edge of sidewall 13*a* may be rectangular, circular or any other shape. Furthermore, upper and lower vertical file cabinet 11, 12 have a top surface 14 having a peripheral edge in the shape of a rectangle, circle or any other shape that allows it to fit within the boundary of the peripheral edge of sidewall 13*a*. It will be understood that sidewall 13*a* and top surface 14 are preferably the same general shape.

The inner perimeter or peripheral edge of sidewall 13*a* of base 13 is slightly larger than the outer perimeter or peripheral edge of top surface 14 to allow for a secure fit between upper and lower file cabinet 11, 12. In particular, sidewall 13*a* includes a top edge 15 and a bottom edge 16, wherein the distance between top edge 15 and bottom edge 16 may be equal to or less than the distance between a top surface 17 of lower file cabinet 12 and a top edge 18*a* of a drawer opening 18. The spacing between top surface 17 and upper edge 18 of a drawer opening allows for maximum overlap between base 13 and top surface 14 without prohibiting the opening of a drawer assembly 19. Additionally, as best seen in FIGS. 2 and 2A, one or more bumpers or washers 13*b* may be attached to lower surface 13*c* of base 13 to assure that one or more screws 30 do not contact top surface 17 of lower file cabinet 12.

Figure 2:
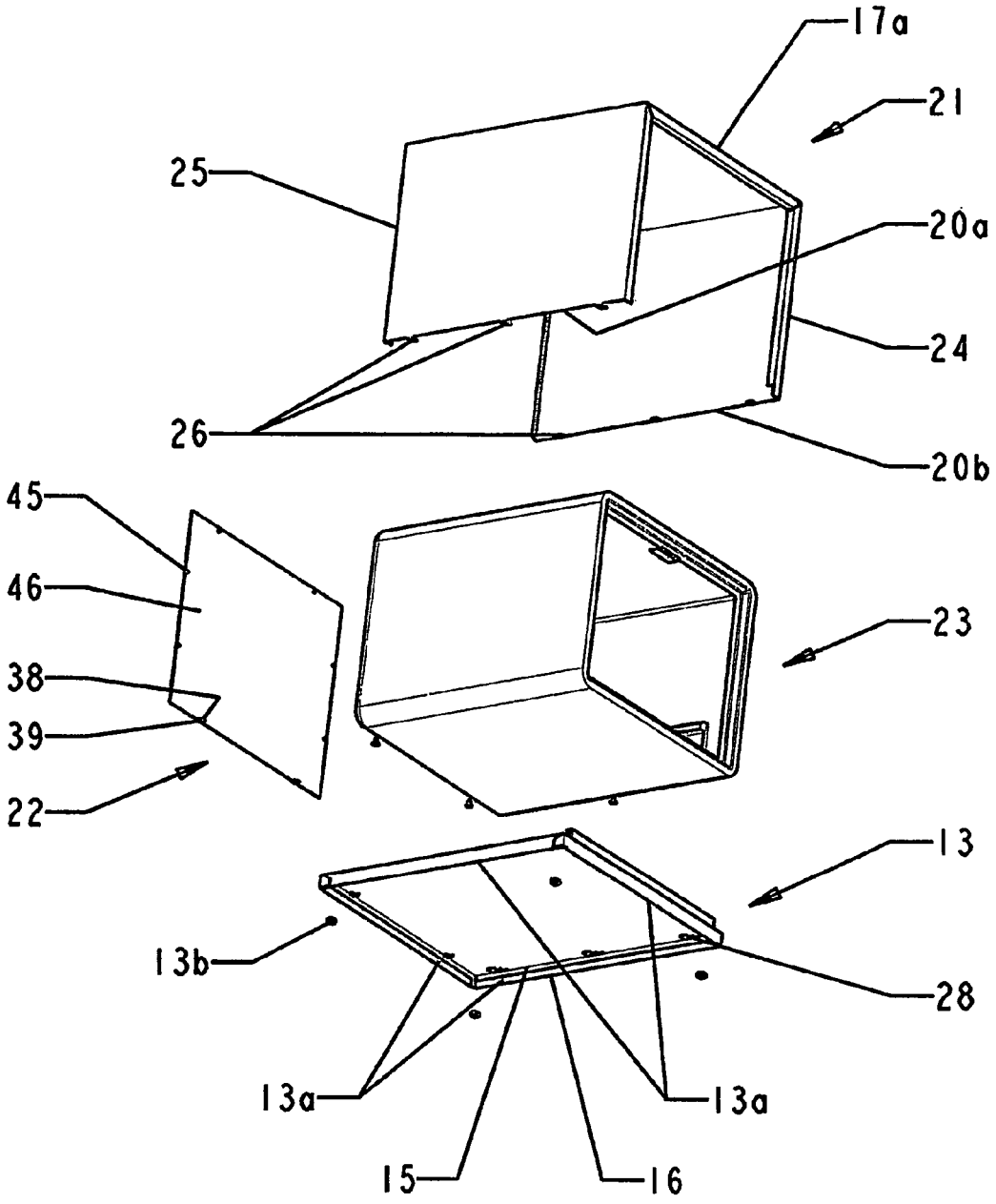
FIG. 2 is an exploded view of at least one of the file cabinets shown in FIG. 1 without a drawer assembly.
Figure 2A:
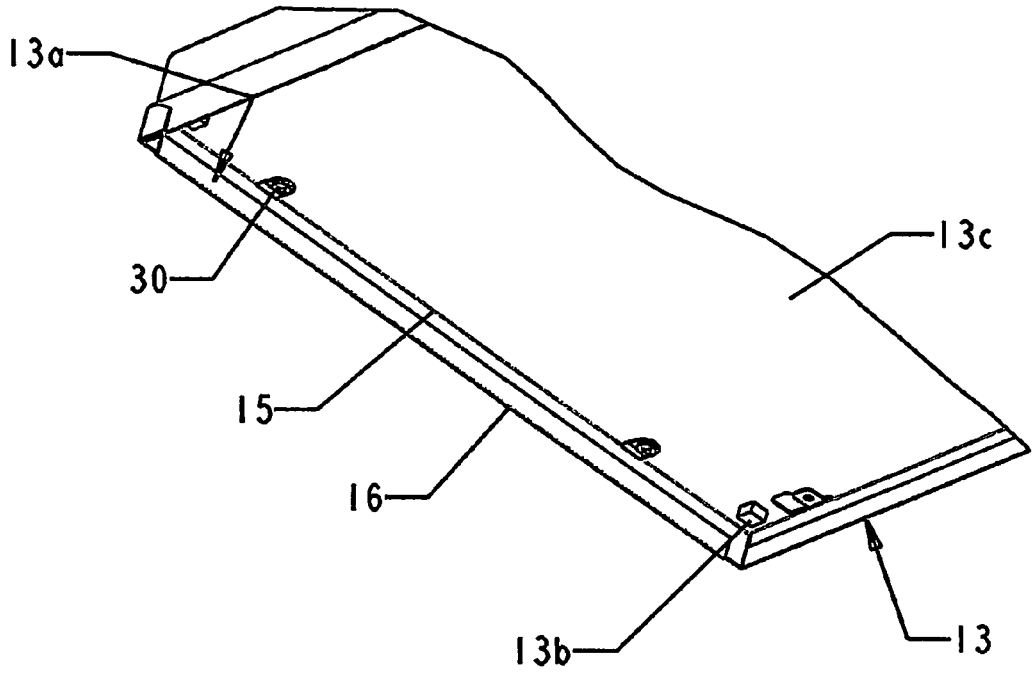
FIG. 2A is a enlarged partial bottom perspective view of a base and an upper shell portion of at least one of the file cabinets shown in FIG. 1.

As best seen in FIGS. 1 and 2A, multi-drawer file cabinet 10 may be assembled by placing upper file cabinet 11 on top of lower file cabinet 12 so that the inner perimeter of sidewall 13*a* fits securely over top surface 14 of lower file 12. After assembly, the drawer assembly 19 will open without contacting bottom edge 16 of base 13. While FIG. 1 illustrates a file cabinet 10 with two individual cabinets, it will be understood that file assemblies with more than two individual cabinet assemblies are also within the scope of the present invention.

Figure 1A:
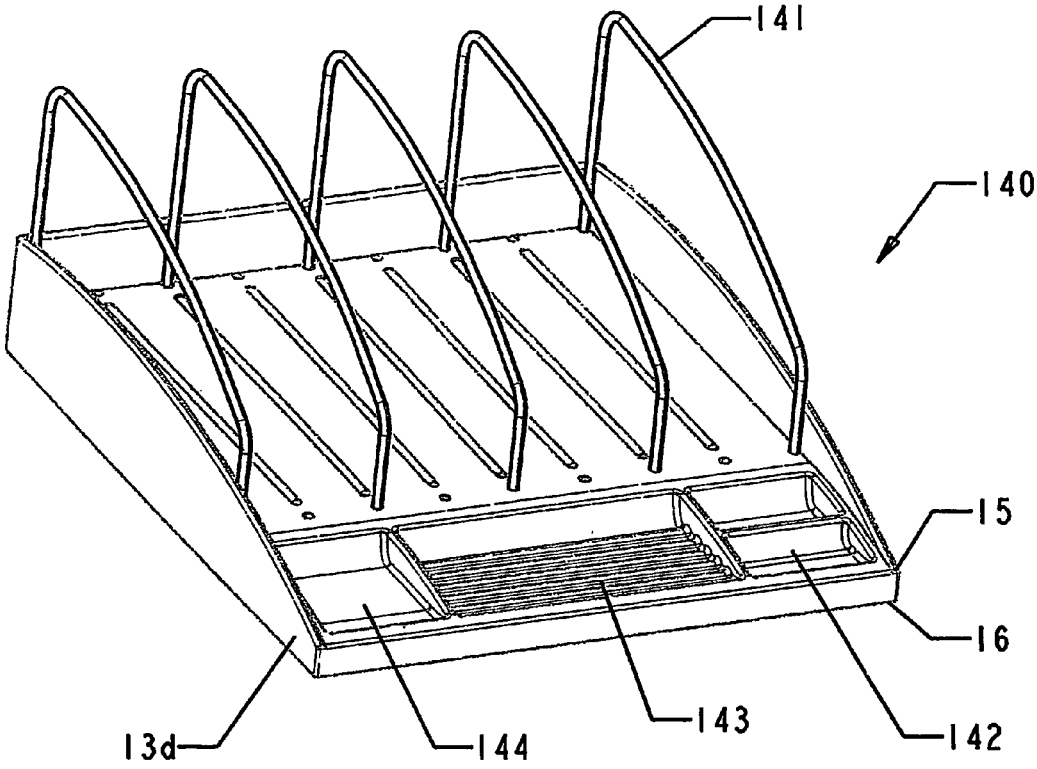
FIG. 1A is a perspective view of an accessory holder that may be used in conjunction with the multi-drawer file cabinet shown in FIG. 1.

As best seen in FIG. 1A, an accessory holder 140 may be placed on top of upper file cabinet 11. Accessory holder 140 may include a base 13*d* that has the same interior dimensions as base 13 of vertical file cabinets 11, 12. Thus, accessory holder 140 may be placed on top portion 14 of upper file cabinet 11 without interfering with the opening of drawer assembly 19. In addition, accessory holder 140 may also include one or more file holders 141, paper clip holders 142, pencil holders 143, and memo pad holders 144. While accessory holder 140 is shown with a particular configuration of accessory slots or compartments, it will be understood that other configurations are also contemplated.

Figure 3:
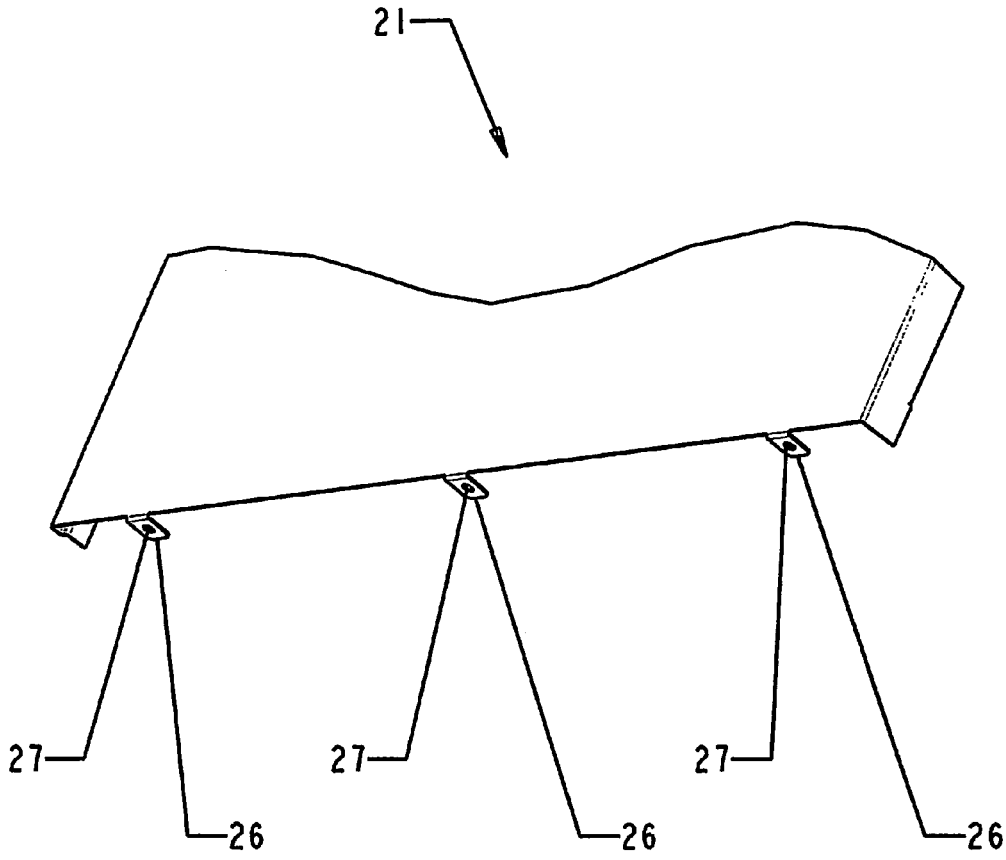
FIG. 3 is an enlarged partial bottom perspective view of the upper shell portion shown in FIG. 2.

As best seen in FIG. 2, each file cabinet 11, 12 may include a three piece sheet metal assembly. Specifically, the sheet metal assembly is made up of an upper shell portion 21, a rear shell portion 22 and base 13. Further, an interior casing or housing 23 is adapted to be positioned within shells 21, 22 and base 13. Upper portion 21 consists of a top section 17*a* and two side sections 24, 25. With additional reference to FIG. 3, side sections 24, 25 each have one or more tabs 26 that extend from at least one of bottom edge 20*a*, 20*b* and extend inwardly generally toward the opposite edge. Also, each of tabs 26 may have a mounting hole 27 defined therein.

Figure 4:
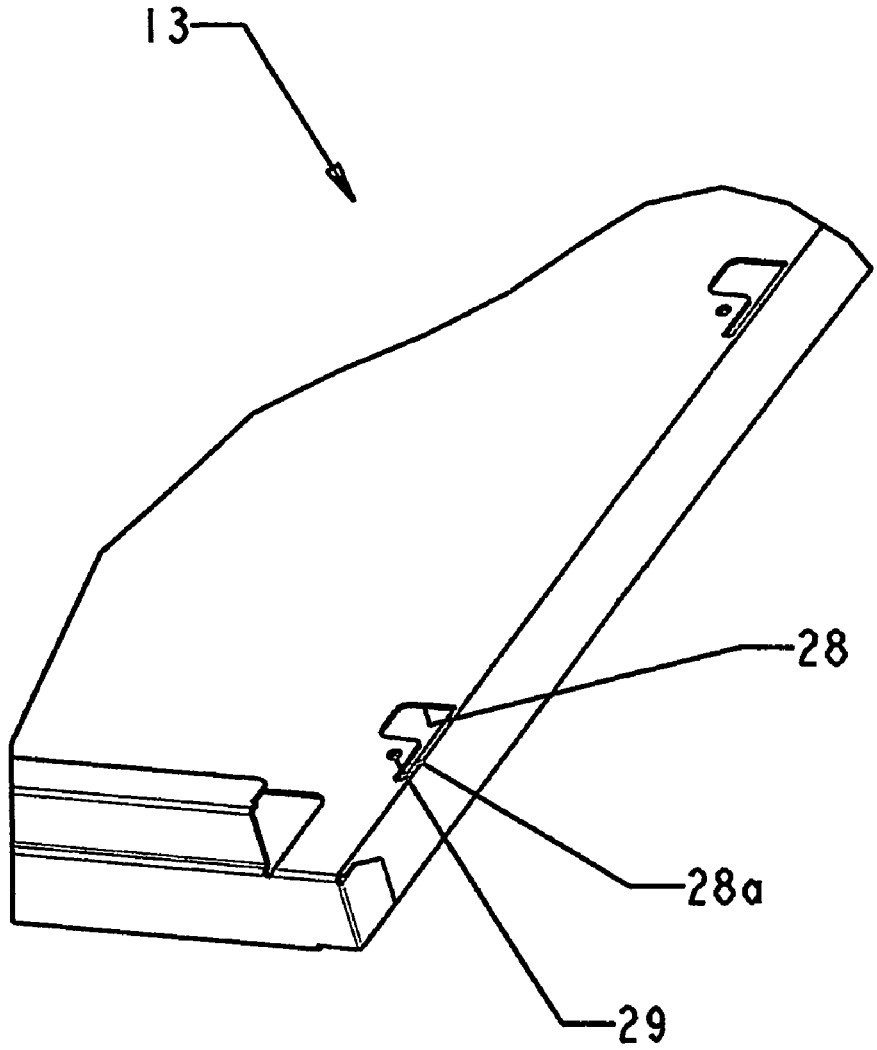
FIG. 4 is an enlarged partial top perspective view of the base shown in FIG. 2.

With additional reference to FIG. 4, base 13 includes a number of slots 28 that corresponds to the number of tabs 26, and has mounting holes 29 that are defined therein positioned adjacent to tabs 26. Slots 28 are positioned and aligned for receiving tabs 26 that extend from side sections 24, 25. Additionally, each of the slots 28 of base 13 also include a fitted groove 28*a*. Groove 28*a* may be sized to allow each of tabs 26 to slide therein after being positioned through their respective slots 28.

Figure 5:
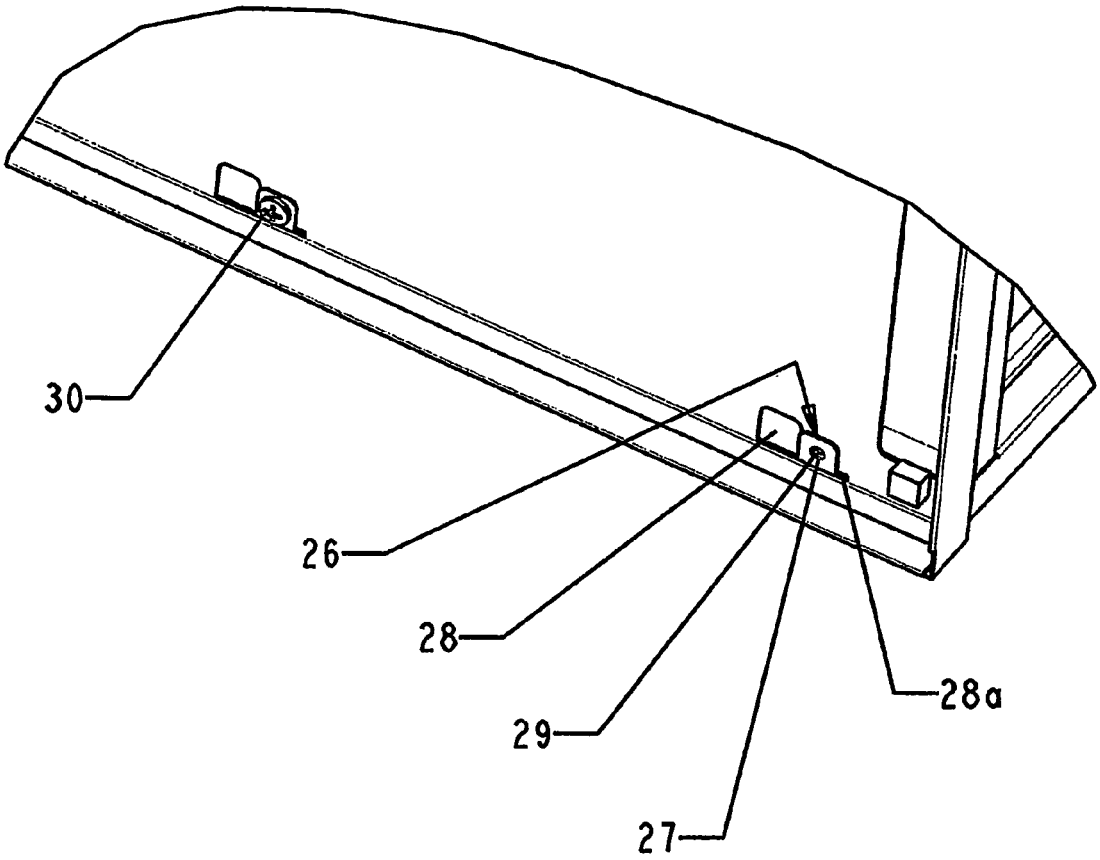
FIG. 5 is an enlarged partial bottom perspective showing the base coupled with the upper shell portion in FIG. 3.

In order to securely attach side sections 24, 25 to base 13, each of the tabs 26 are placed into their respective slots 28 on base 13. As best seen in FIG. 5, tabs 26 are then slid into grooves 28*a* until the central mounting hole 27 of tab 26 is aligned with mounting hole 29. To further secure upper shell portion 21 to base 13, screw 30 or other suitable fastener may be fastened within holes 27 and 29.

Figure 6:
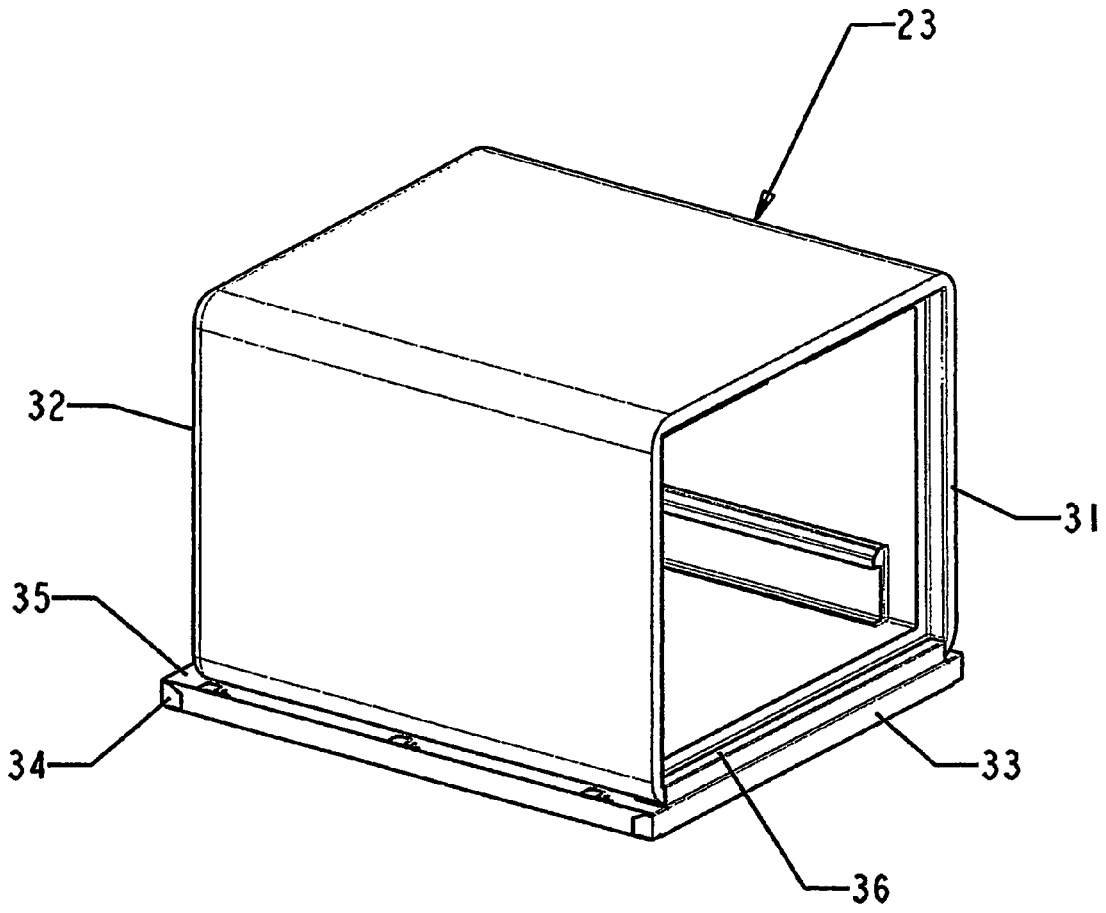
FIG. 6 is a perspective view of the base and an interior casing of at least one of the file cabinets shown in FIG. 1.
Figure 7:
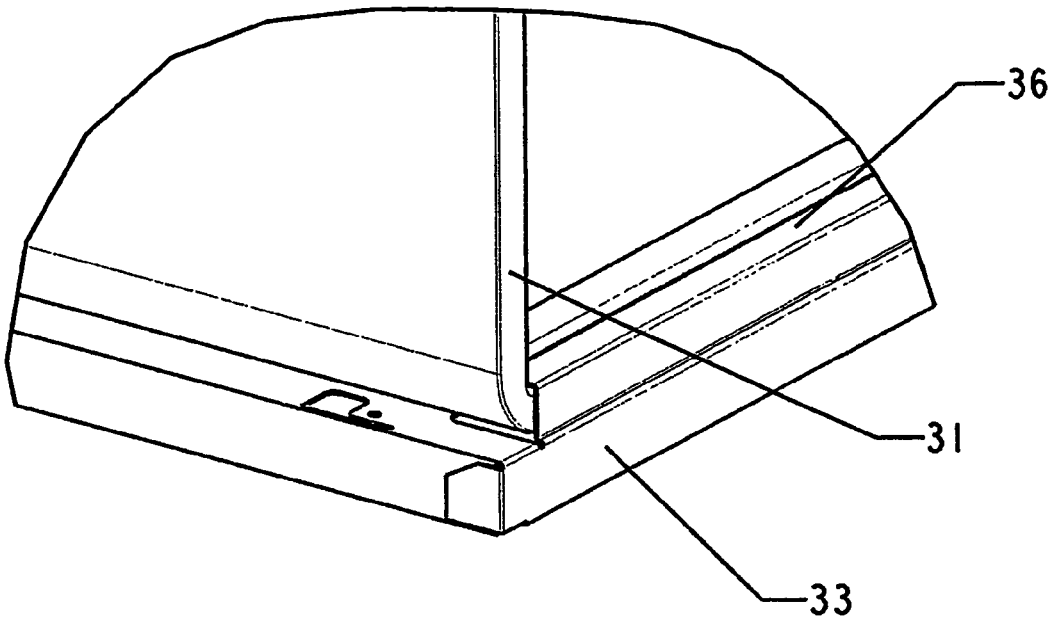
FIG. 7 is an enlarged partial perspective view of the interior casing engaged with a front portion of the base.
Figure 8:
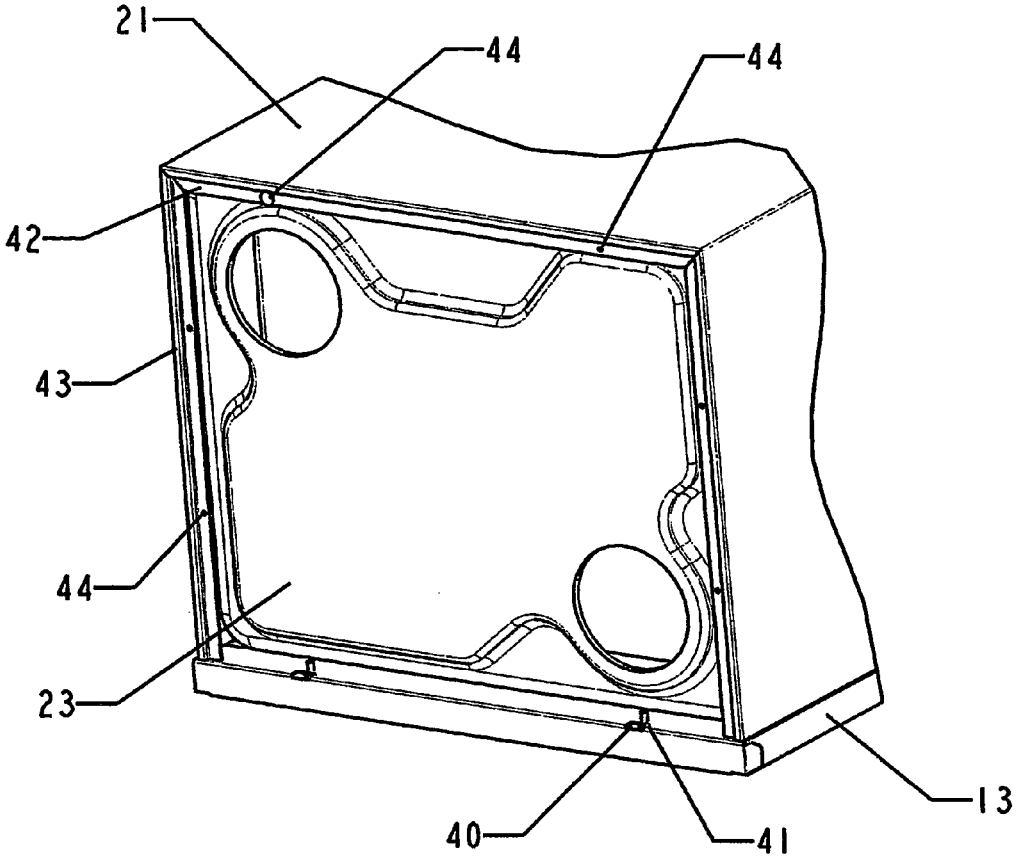
FIG. 8 is a partial rear perspective view of the upper shell portion, the base, and the interior casing shown in FIG. 2.

As best seen in FIGS. 6-8, interior casing 23 includes a front side 31, a rear side 32 and may be blow molded or formed by other processes or methods. Additionally, base 13 further includes a front end 33, a back end 34, a top surface 35, and a lip 36. While the illustrations of FIGS. 6 and 7 show interior casing 23 on base 13 without upper shell portion 21 attached to the base 13, interior casing 23 may also be added to base 13 prior to, or after, the aforementioned step of attaching upper shell portion 21 to base 13.

To further secure interior casing 23 to base 13, interior casing 23 is placed on top surface 35 of back end 34 of base 13, and then slid forward toward the front end 33 of base 13. When front side 31 of interior casing 23 converges with front end 33 of top surface 35 of base 13, it engages lip 36 that is attached to and extends from base 13. Specifically, lip 36 extends upwardly from top surface 35 and bends at approximately a right angle towards back end 34 of base 13. Lip 36 shall serve to secure interior casing 23 to base 13.

As best seen in FIGS. 5 and 8, once interior casing 23 is secured to base 13, and upper shell portion 21 is secured to base 13, it will be understood that casing 23 is filled with insulation material. The insulation material may be a non-flammable, thermal insulating material, generally made of a mixture that solidifies in a mold. The steps of placing interior casing 23 into the cabinet between upper shell portion 21 and base 13, and then filling it with the insulation material has the added benefit of providing a brace and additional support for the cabinet.

As best seen in FIGS. 2 and 8, upon the addition of the insulation material into interior casing 23, the rear shell portion 22 is mounted to base 13 and upper shell portion 21. The rear shell portion 22 may have one or more mounting holes 45 defined therein, and a plurality of tabs 38 having a mounting hole 39 defined in each tab 38. Moreover, the rear surface of upper shell portion 21 include one or more mounting holes 44 defined therein, and base 13 has a plurality of slots 40 with adjacent mounting holes 41 defined therein. The mounting holes 44 defined in upper portion 21 of the assembly are located on a recessed surface 42. Recessed surface 42 is indented from outer surface 43 a distance corresponding to the thickness of the rear shell portion 22, wherein outer surface 46 of rear shell portion 22 may be flush with outer surface 43 of the cabinet assembly.

The assembly of the rear shell portion 22 is completed by inserting tabs 38 into slots 41 and aligning mounting holes 39 with mounting holes 41. Additionally, mounting holes 45 of the rear shell portion 22 are aligned with mounting holes 44 on recessed surface 42. Screws (not shown) or any suitable fasteners may be used to secure the rear shell portion 22 to upper shell portion 21 by using the aforementioned mounting holes.

Figure 9:
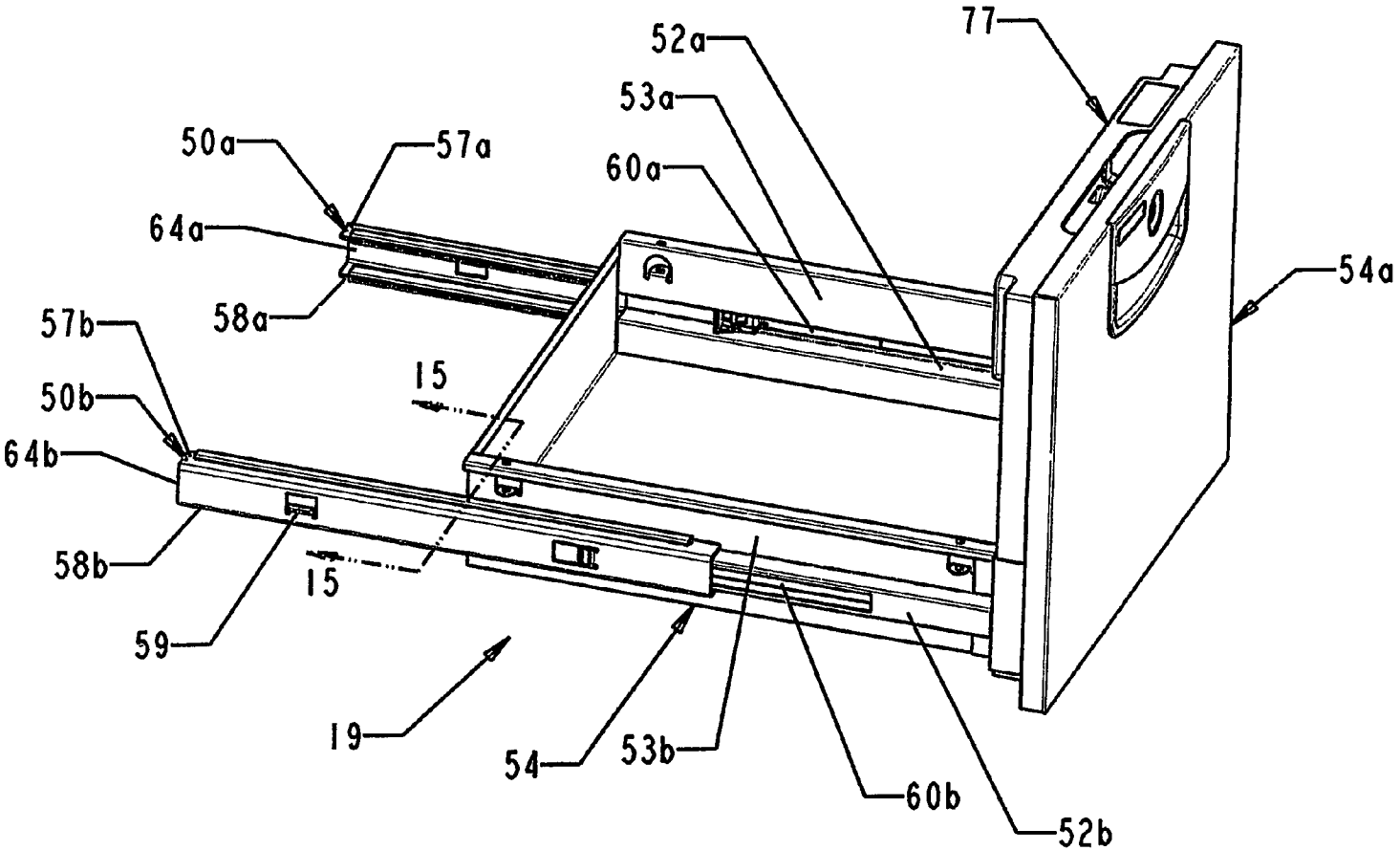
FIG. 9 is a side perspective view of the drawer assembly shown in FIG. 1.

As best seen in FIG. 9, drawer assembly 19 includes a front drawer assembly 54*a*, a drawer frame 54 and two opposing slide members 50*a*, 50*b* that allow the drawer assembly to move relative to interior casing 23. With additional reference to FIGS. 10 and 11, each slide member 50*a*, 50*b* is disposed between a pair of outer tracks 51*a*, 51*b* and integral drawer tracks 52*a* and 52*b*. Outer tracks 51*a*, 51*b* may be integrally formed on the interior sidewalls of interior casing 23, and integral drawer tracks 52*a* and 52*b* formed in the outside surface of sidewalls 53*a* and 53*b* of drawer assembly 19.

Figure 10:
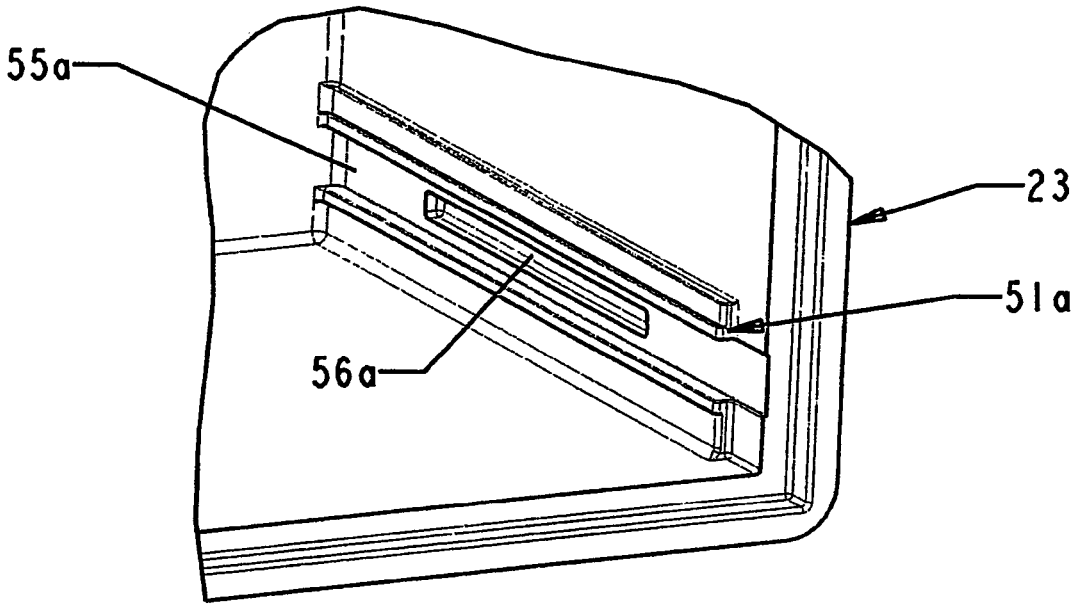
FIG. 10 is an enlarged partial perspective view of the interior casing.
Figure 11:
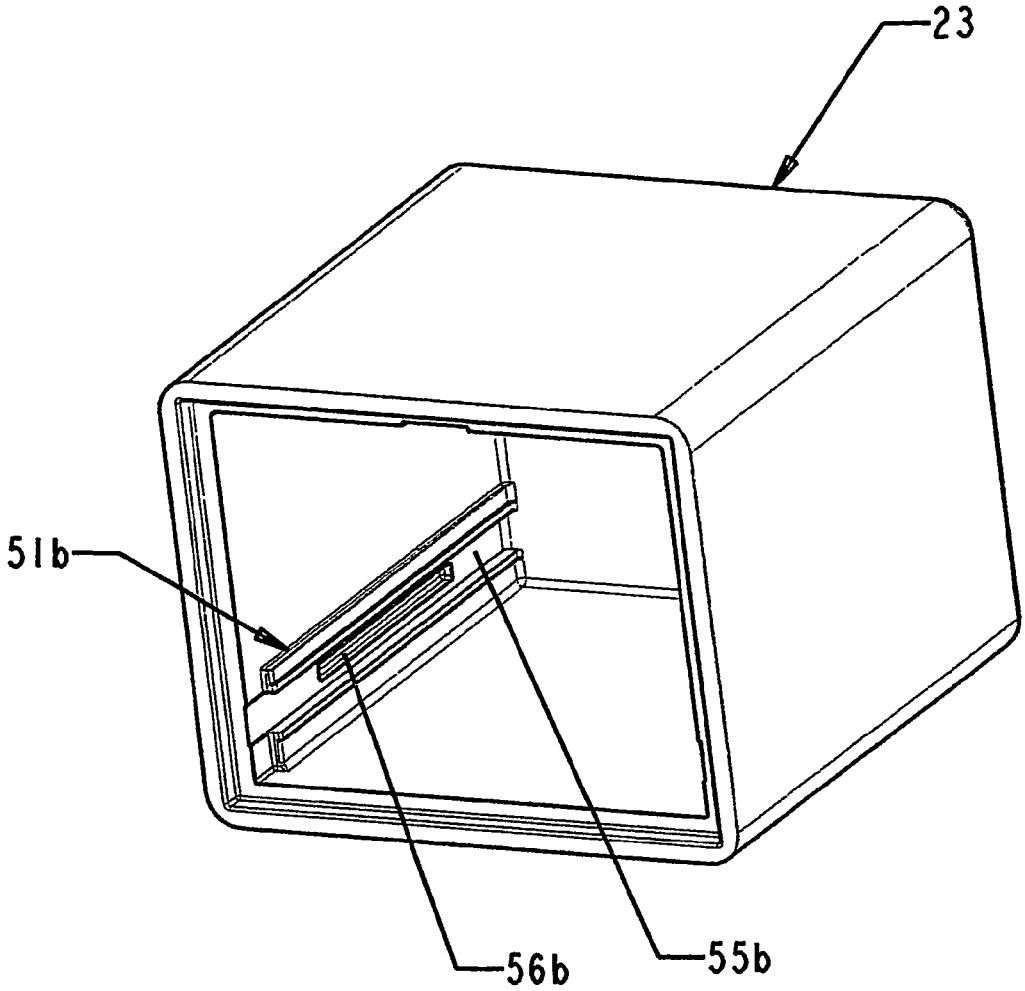
FIG. 11 is a perspective view of the interior casing shown in FIG. 2.
Figure 12:
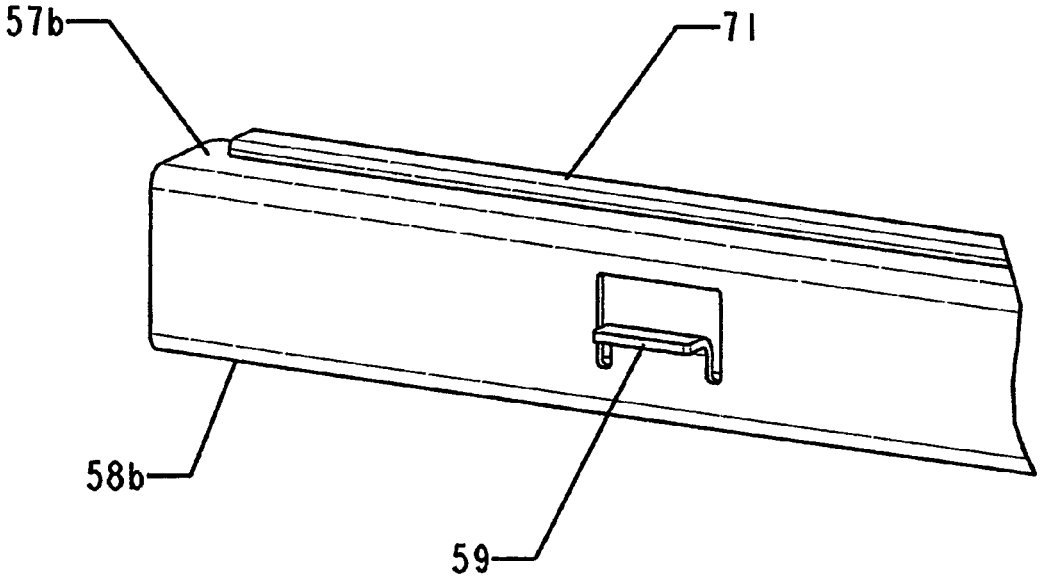
FIG. 12 is an enlarged partial perspective view of a side member of the drawer assembly shown in FIG. 9.

As best seen in FIGS. 10 and 11, each of outer tracks 51*a* and 51*b* are formed on the interior of interior casing 23 and further include a first outer groove 55*a*, 55*b* and a second inner groove 56*a*, 56*b*. With additional reference to FIGS. 9 and 12, slide members 50*a*, 50*b* each comprise an upper surface 57*a*, 57*b*, a lower surface 58*a*, 58*b*, and an outwardly protruding stop 59. When drawer assembly 19 is installed in the interior casing 23, each of the stops 59 extend into inner grooves 56*a*, 56*b* thereby providing a first drawer stop, and each slide member 50*a*, 50*b* is slidably disposed in outer grooves 55*a*, 55*b* on the interior wall of interior casing 23. It will also be understood that slide members 50*a*, 50*b* may be one common piece (not shown), in which left and right side slide members 50*a*, 50*b* are attached by a rear rail. The rear rail may serve as an additional support to retain left and right outside slide members within the slide rail groove in the interior wall.

As best seen in FIG. 9, integral drawer tracks 52*a*, 52*b* protrude from the outside surface of sidewalls 53*a*, 53*b* of drawer assembly 19 and have elongated slots 60*a*, 60*b* defined therein. With additional reference to FIGS. 13 and 14, slide members 50*a*, 50*b* further comprise inwardly extending slide tabs 61*a*, 61*b*, each having a lock slot 62 defined therein, respectively.

Figure 13:
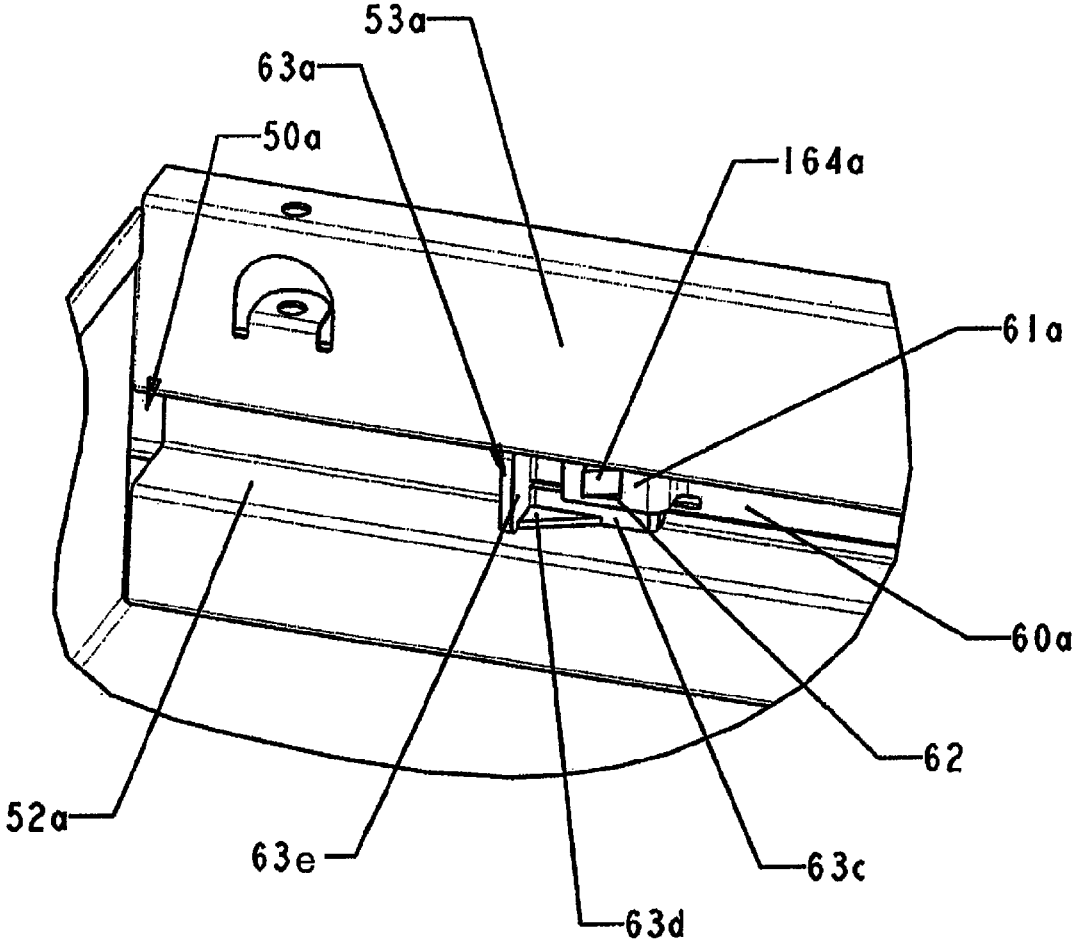
FIG. 13 is an enlarged partial perspective view of the drawer assembly shown in FIG. 9.
Figure 14:
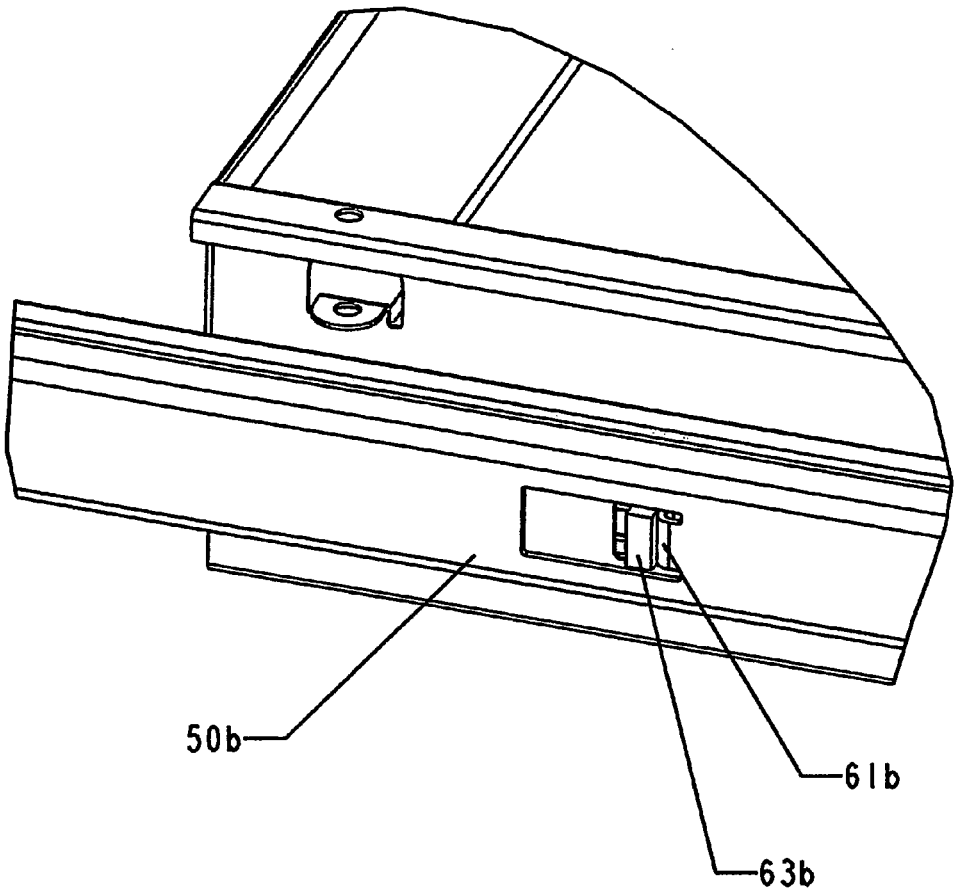
FIG. 14 is an enlarged partial perspective view of the drawer assembly shown in FIG. 9.

When assembled, as best seen in FIG. 9, the drawer tracks 52*a*, 52*b* protruding from the outside surface of sidewalls 53*a*, 53*b* of drawer assembly 19 are inserted into the respective inner channels 64*a*, 64*b* of slide members 50*a*, 50*b*. Slide tabs 61*a*, 61*b* are inserted into the respective elongated slots 60*a*, 60*b* of sidewalls 53*a*, 53*b* of drawer assembly 19 as best seen in FIG. 13. Drawer assembly 19 is then secured to slide members 50*a*, 50*b* through the use of clips 63*a*, 63*b*. Each clip 63*a*, 63*b*, includes a locking tab 164 for insertion into lock slot 62 of slide tabs 61*a*, 61*b*. Further, clips 63*a*, 63*b* may be formed of a plastic material and include a flange 63*e* that extends generally perpendicular to an engaging portion 63*c*. Also, it will be understood that a brace 63*d* may extend between flange 63*e* and portion 63*c*.

In addition to serving to secure drawer frame 54 to the two slide members 50*a*, 50*b*, plastic clips 63*a*, 63*b* assure that the metal slide tabs 61*a*, 61*b* do not contact the metal from drawer assembly 19 when the drawer is opened. Additionally, to further minimize contact between the metal surfaces of sidewalls 53*a*, 53*b* and slide members 50*a*, 50*b*, upper extrusions 71 and lower extrusions 69 may be added to upper surfaces 57*a*, 57*b* and lower surfaces 58*a*, 58*b* of slide members 50*a*, 50*b*, respectively.

Figure 15:
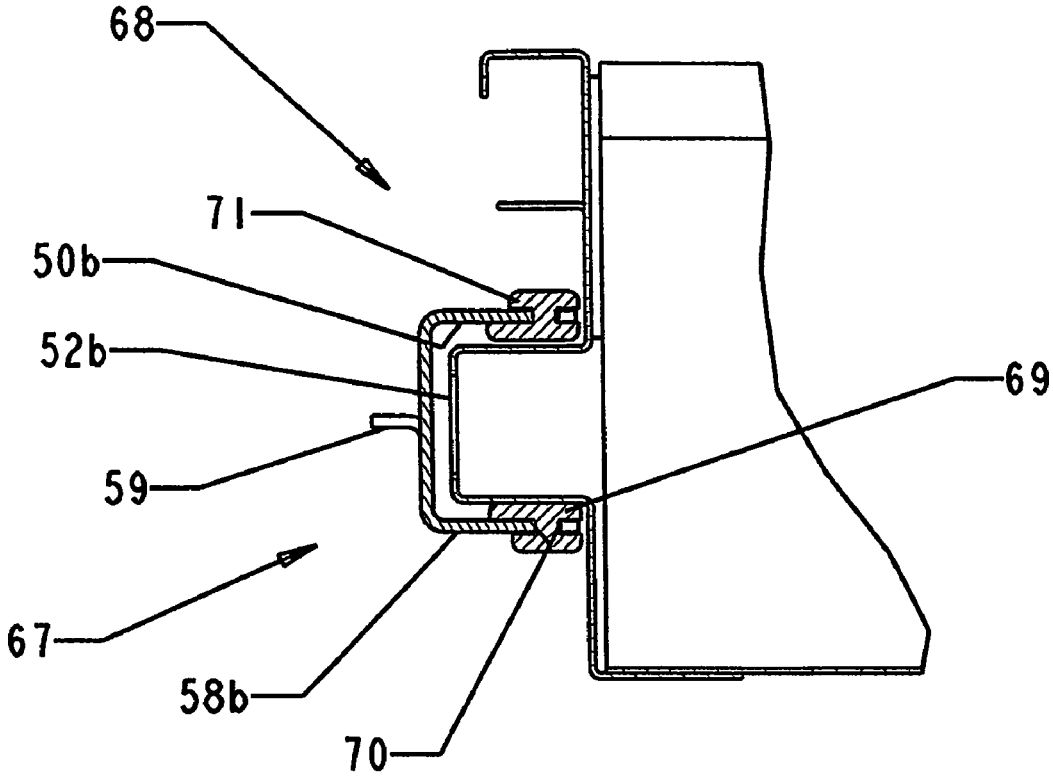
FIG. 15 is a cross-sectional view taken along line 15-15 in FIG. 9.

As best seen in FIG. 15, upper extrusions 71 or lower extrusions 69 may be formed in an H-shape so that they fit within a slot 70 formed in each of the respective upper surfaces 57*a*, 57*b* and lower surfaces 58*a*, 58*b* of slide members 50*a*, 50*b*. It will also be understood that upper and lower extrusions may be C-shaped so that extrusions 65, 66 slip over the end of the respective surfaces of the slide members 50*a*, 50*b*. If the extrusion is C-shaped, the extrusion may be secured to slide member 50*a*, 50*b* by a tab (not shown) that is integrally formed with the respective surface of the slide member. The extrusions may be plastic or any other suitable material.

Figure 16:
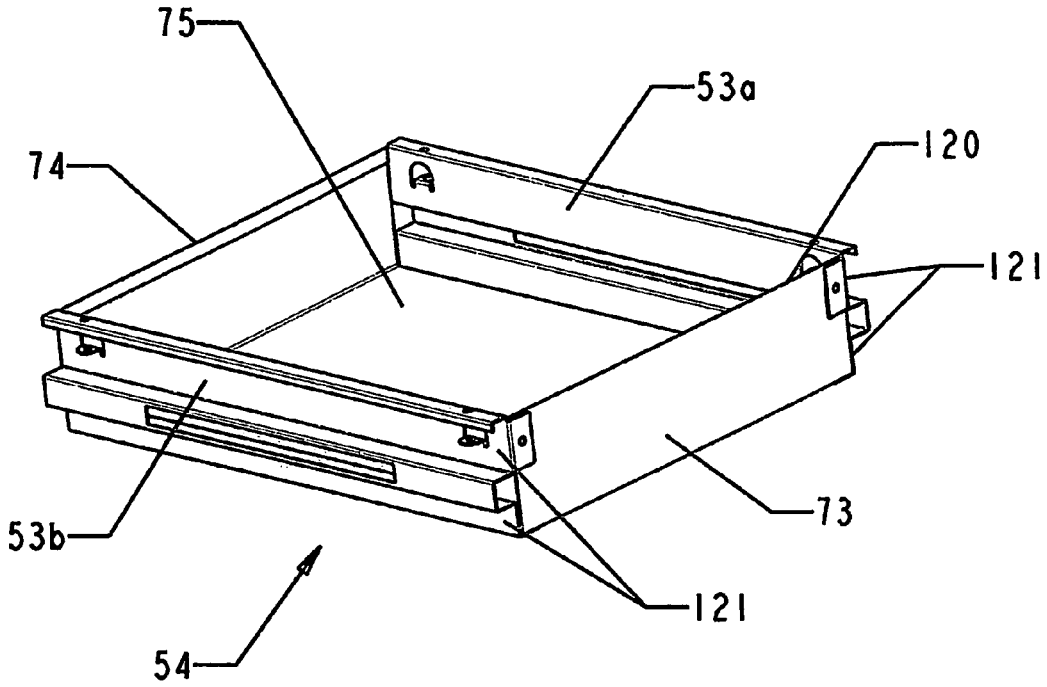
FIG. 16 is a perspective view of a drawer frame that is a component of the drawer assembly shown in FIG. 9.

As best seen in FIG. 16, a drawer frame 54 is shown with sidewalls 53*a*, 53*b*, a front section 73, a back section 74, and a bottom section 75. Front section 73, back section 74, and bottom section 75 may be constructed from a single piece of sheet metal, but other configurations are also contemplated. Additionally, the sidewalls 53*a*, 53*b* are coupled with front section 73, back section 74, and bottom section 75 by any suitable method of attaching sheet metal, such as, but not limited to, a "Tog-L-Lock" fastening device.

Figure 17:
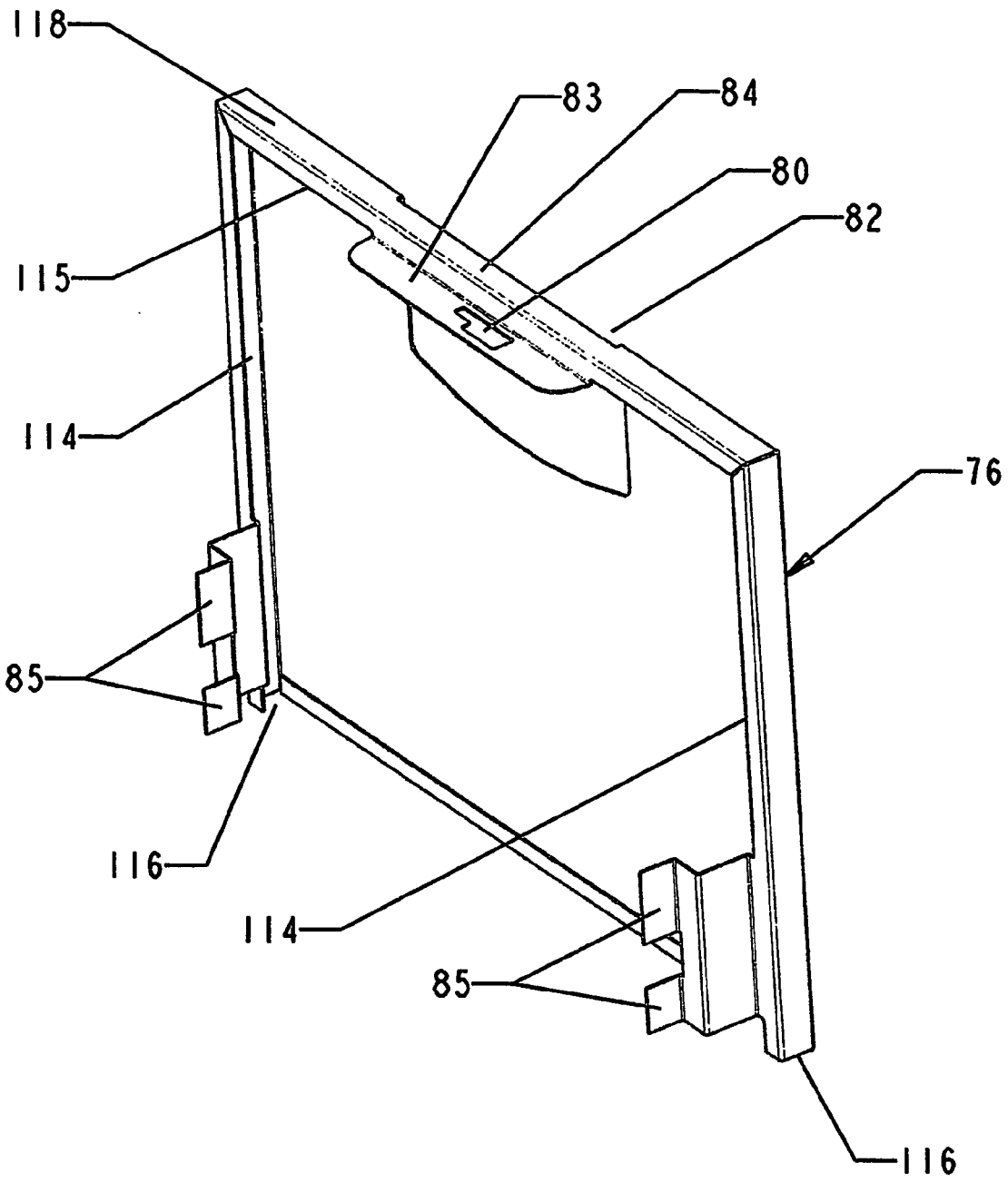
FIG. 17 is a rear perspective view of a drawer front that is a component of the drawer assembly shown in FIG. 9.
Figure 18:
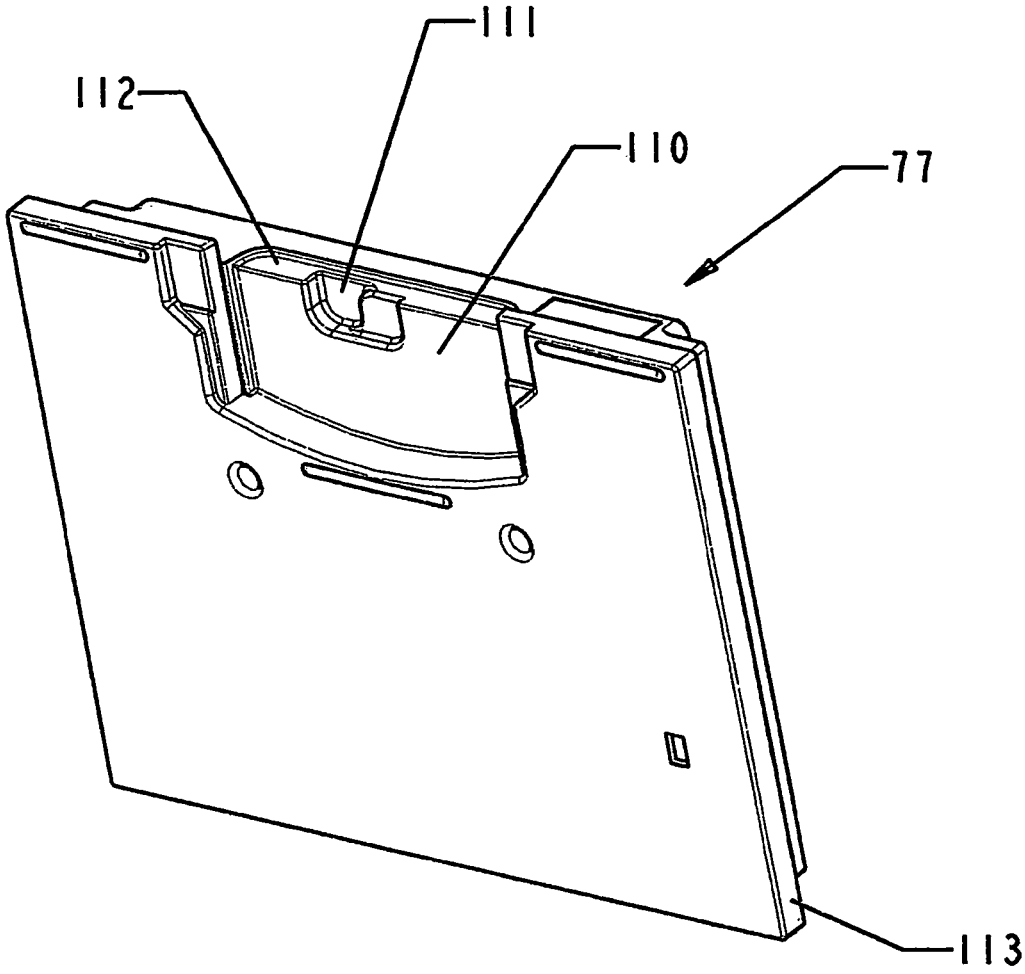
FIG. 18 is a front perspective view of a drawer head that is a component of the drawer assembly shown in FIG. 9.

As best seen in FIGS. 9 and 17-21, a front drawer assembly 54*a* includes a drawer front 76, a blow molded drawer head 77, an escutcheon plate 78, and a locking mechanism 79. As will be described below, front drawer assembly 54*a* may be assembled without tools or fasteners thereby reducing assembly costs. In particular, as best seen in FIG. 17, drawer front 76 may be formed of sheet metal and includes an escutcheon plate opening 80, a faceplate recess 82, a sheet metal ledge 83, a latching slot 84, and attaching tabs 85. With reference to FIGS. 20, 20A, 20B and 20C, escutcheon plate 78 includes a pair of side support members 88 and a rim 87, and is attached to drawer front 76 by first inserting rim 87 through escutcheon plate opening 80. In order to assure that escutcheon plate 78 is securely attached to drawer front 76, rim 87 of escutcheon plate 78 may be inserted into faceplate recess 82 and a pair of holding clips 86 (FIG. 22) may be inserted between side support members 88 and the back surface of drawer front 76. Each of holding clips 86 have a protrusion that is adapted to snap within an aperture 86*a* to securely keep escutcheon plate 78 coupled with drawer front 76.

Figure 21:
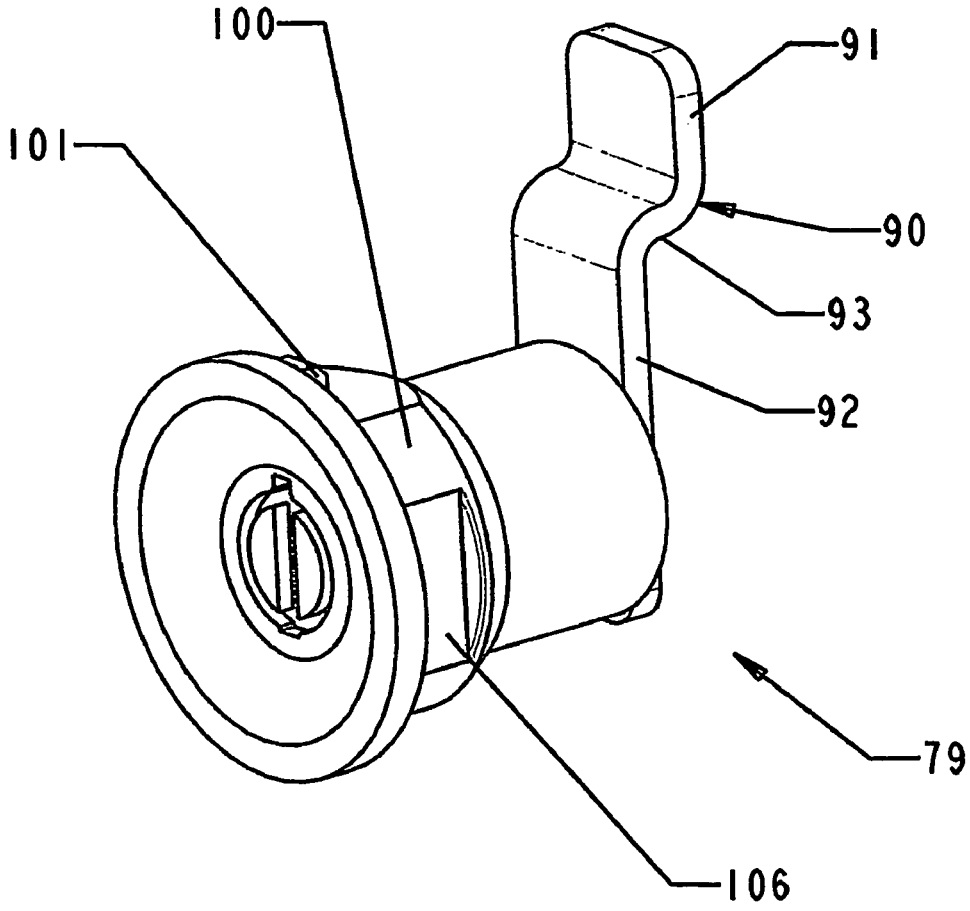
FIG. 21 is a front perspective view of a locking mechanism that is adapted to be mounted to the escutcheon plate shown in FIGS. 20 and 20C.
Figure 21A:
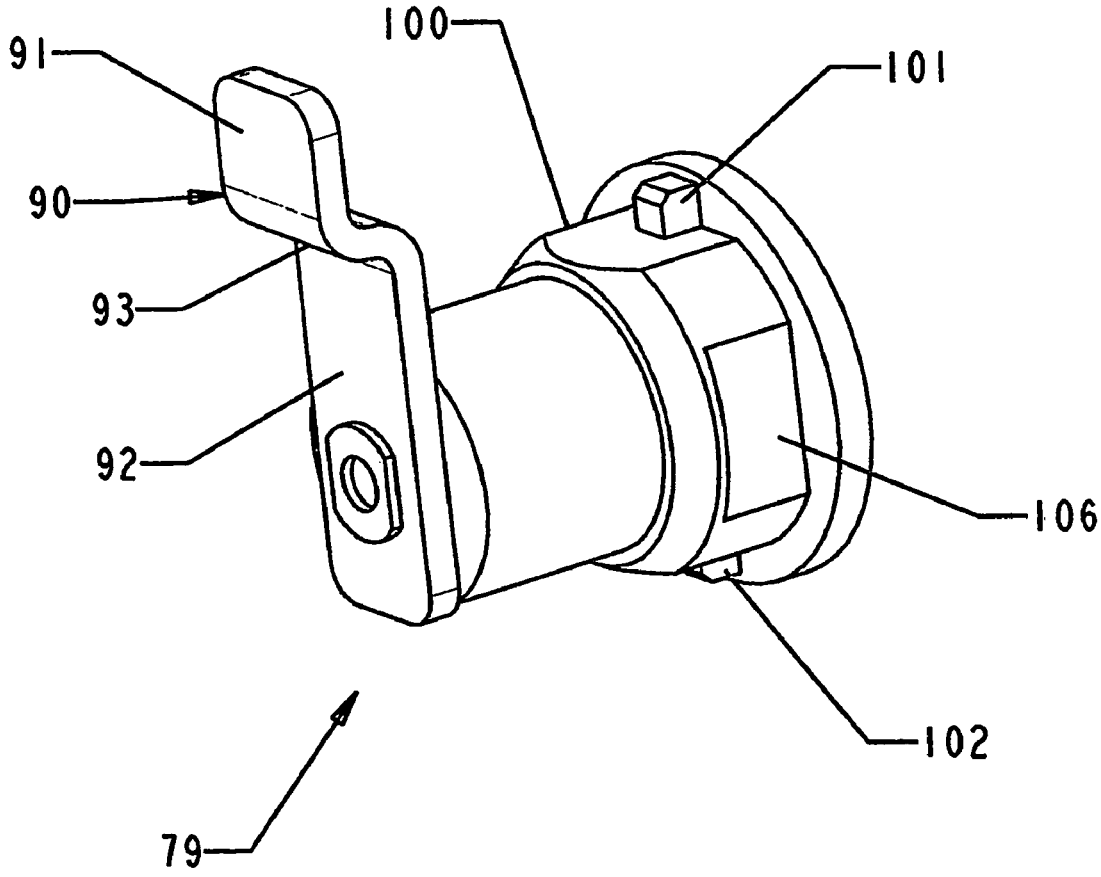
FIG. 21A is a rear perspective view of the locking mechanism shown in FIG. 21.
Figure 22:
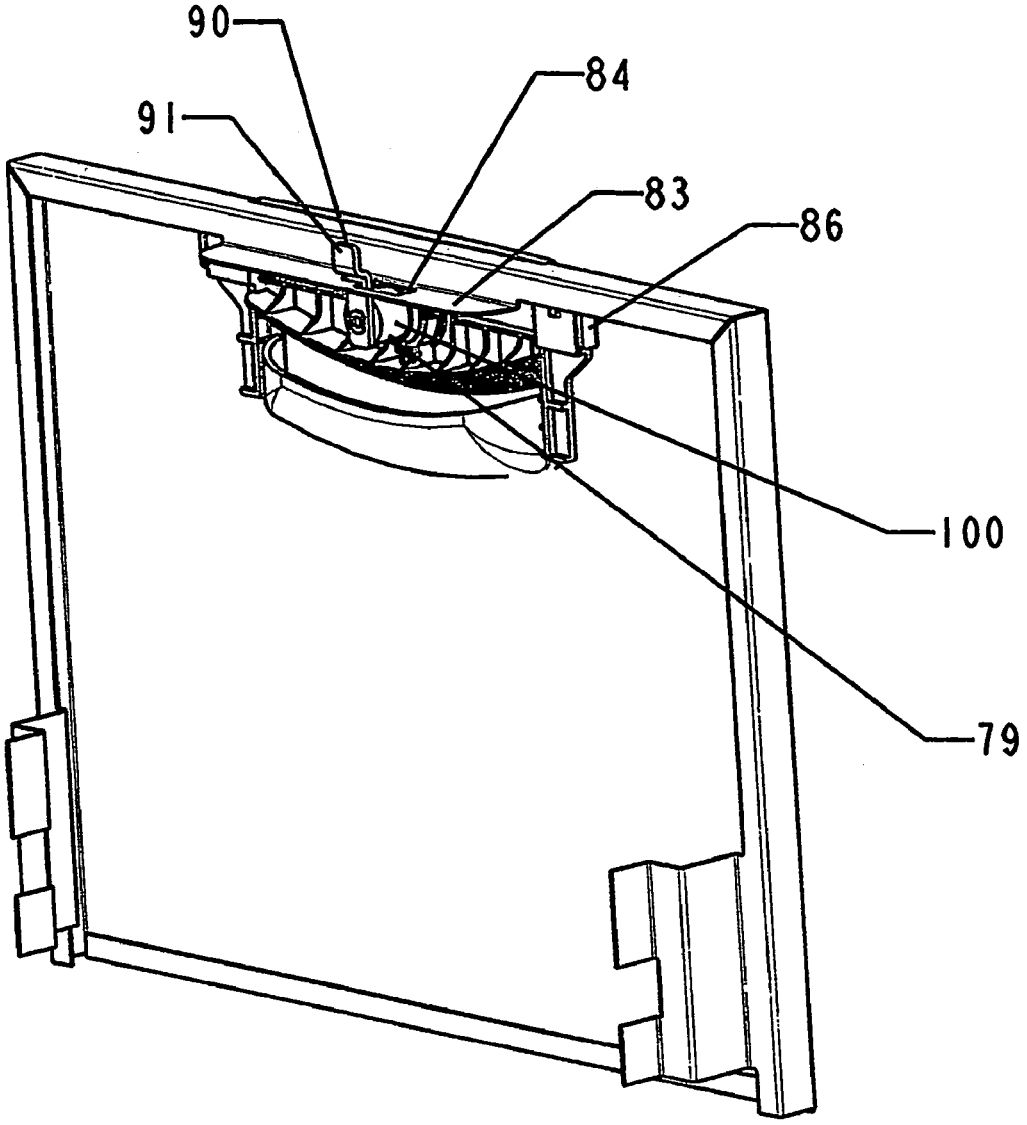
FIG. 22 is a rear perspective view of the escutcheon plate and locking mechanism secured to the drawer front with a pair of holding clips.

As best seen in FIGS. 21, 21A and 22, a locking assembly 79 may be movably mounted in drawer assembly 19, and particularly in front drawer assembly 54*a*, for transition between closed and opened positions to selectively prevent access to the interior compartment of internal casing 23. In general, locking assembly 79 includes a body 100 that may be formed of a die cast material, and a cam 90 that may be formed of steel. Cam 90 may be Z-shaped and further comprises a locking leg 91, an attaching leg 92, and a flat portion 93. In addition, attaching leg 92 may have a slot (not shown) defined therein to allow cam 90 to be attached to a internal bezel (not shown) through the use of a fastening mechanism.

With reference to FIGS. 20, 20C, 21, 21A and 22, locking assembly 79 may be mounted through the front of escutcheon plate 78 in drawer face 76. In doing so, an upper tab 101 and a lower tab 102 of locking assembly 79 are aligned with an upper slot 103 and a lower slot 104 on escutcheon plate 78 to assure proper positioning. Once locking assembly 79 is properly aligned, a plurality of side tabs 105 of escutcheon plate 78 are snapped into a pair of side recesses 106 defined in locking assembly 79, thereby securing locking assembly 79 with escutcheon plate 78.

As best seen in FIG. 17, two side grooves 114 and a top groove 115 are formed on the outer perimeter of drawer front 76. With additional reference to FIGS. 18 and 19, drawer head 77 also includes an escutcheon plate receiving recess 110, a lock assembly receiving recess 111, a ledge 112 and a lip 113. Drawer head 77 is attached to drawer front 76 by sliding lip 113 into the two side grooves 114 formed on the outer perimeter of drawer front 76 through entry points 116. Drawer head 77 is in position when upper surface 117 of lip 113 contacts upper surface 118 in top groove 115. Drawer head 77 is then secured to drawer front 76 at the top 115 and two sides 114.

Figure 19:
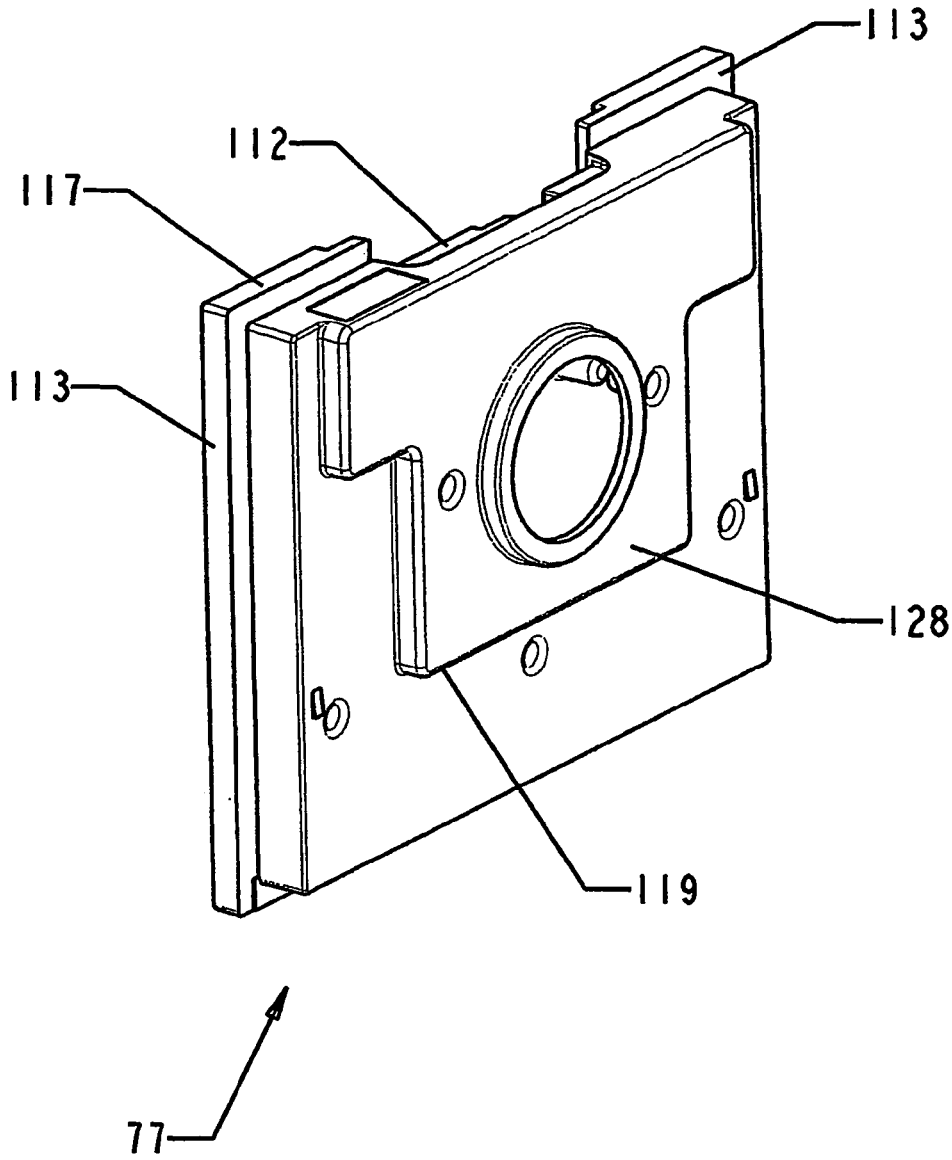
FIG. 19 is a rear perspective view of the drawer head shown in FIG. 9.
Figure 20:
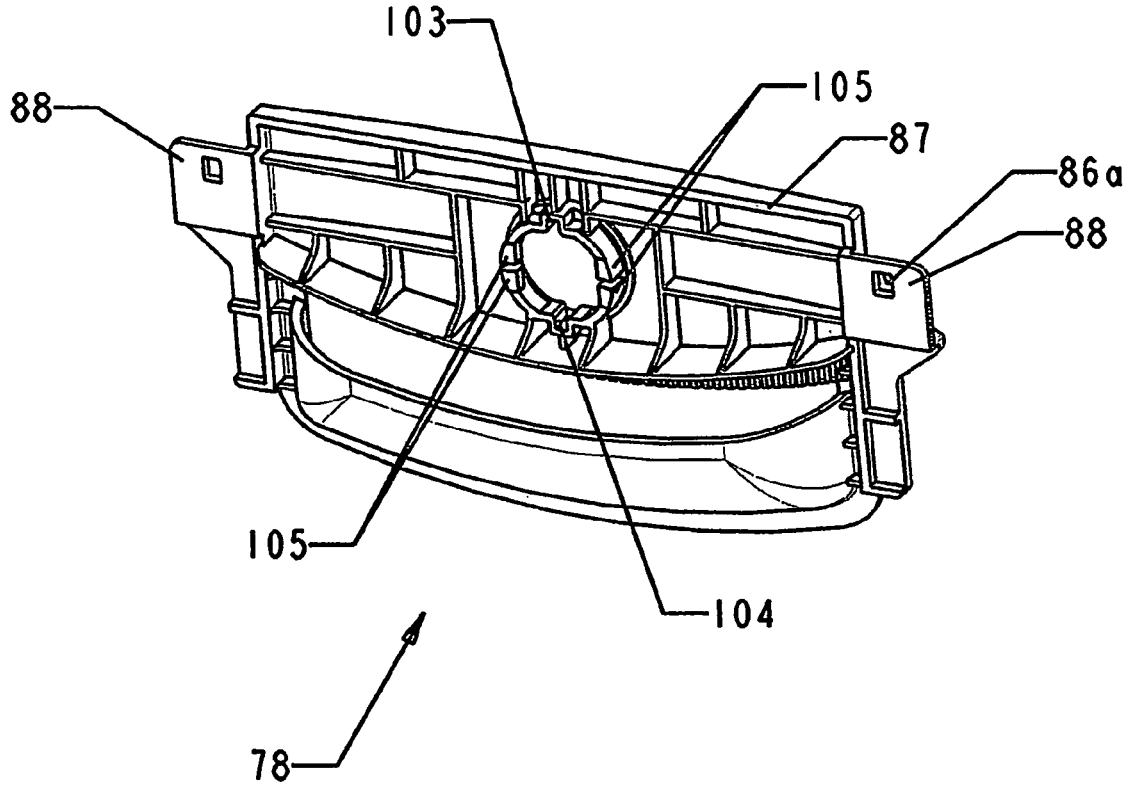
FIG. 20 is a rear perspective view of an escutcheon plate that is a component of the drawer assembly shown in FIG. 9.
Figure 20A:
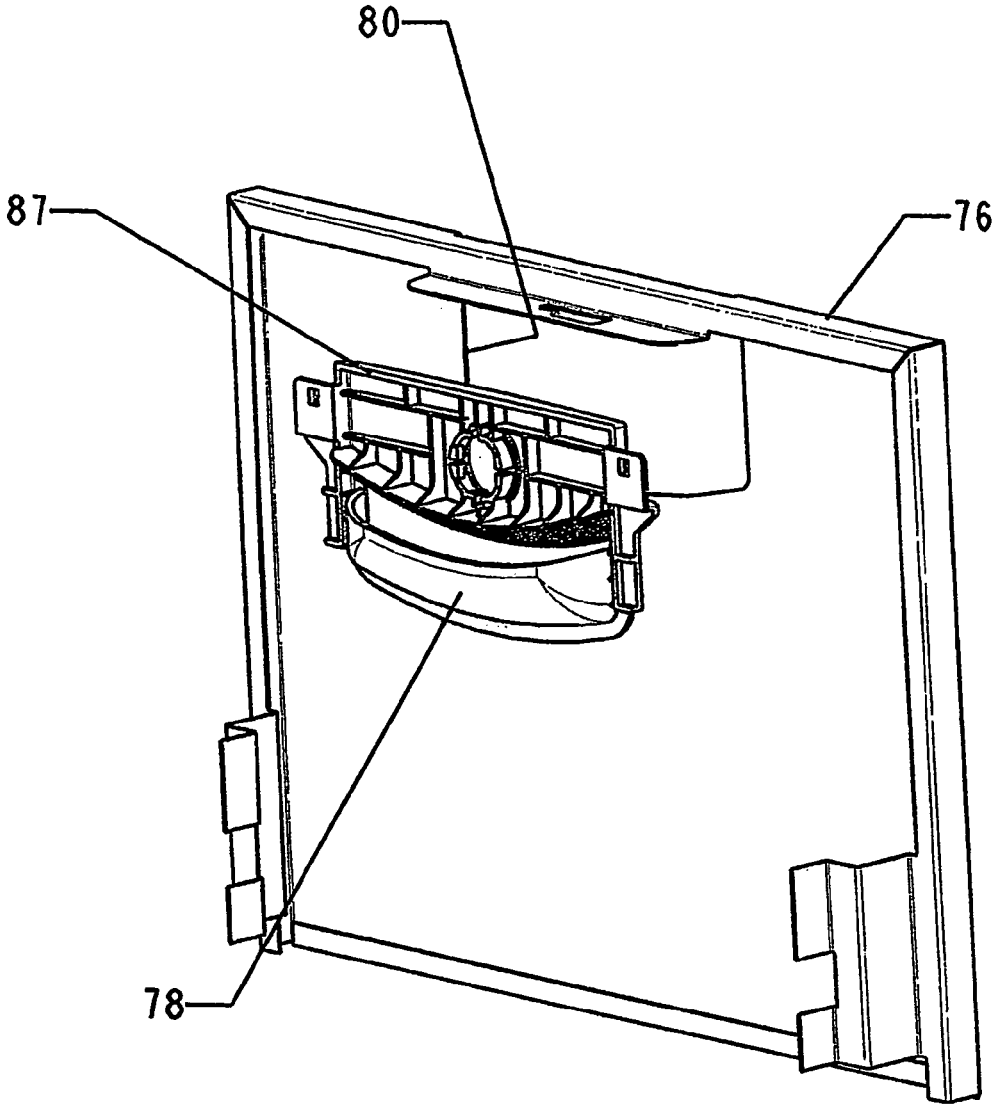
FIG. 20A is a rear perspective exploded view of the drawer front and escutcheon plate of the drawer assembly.
Figure 20B:
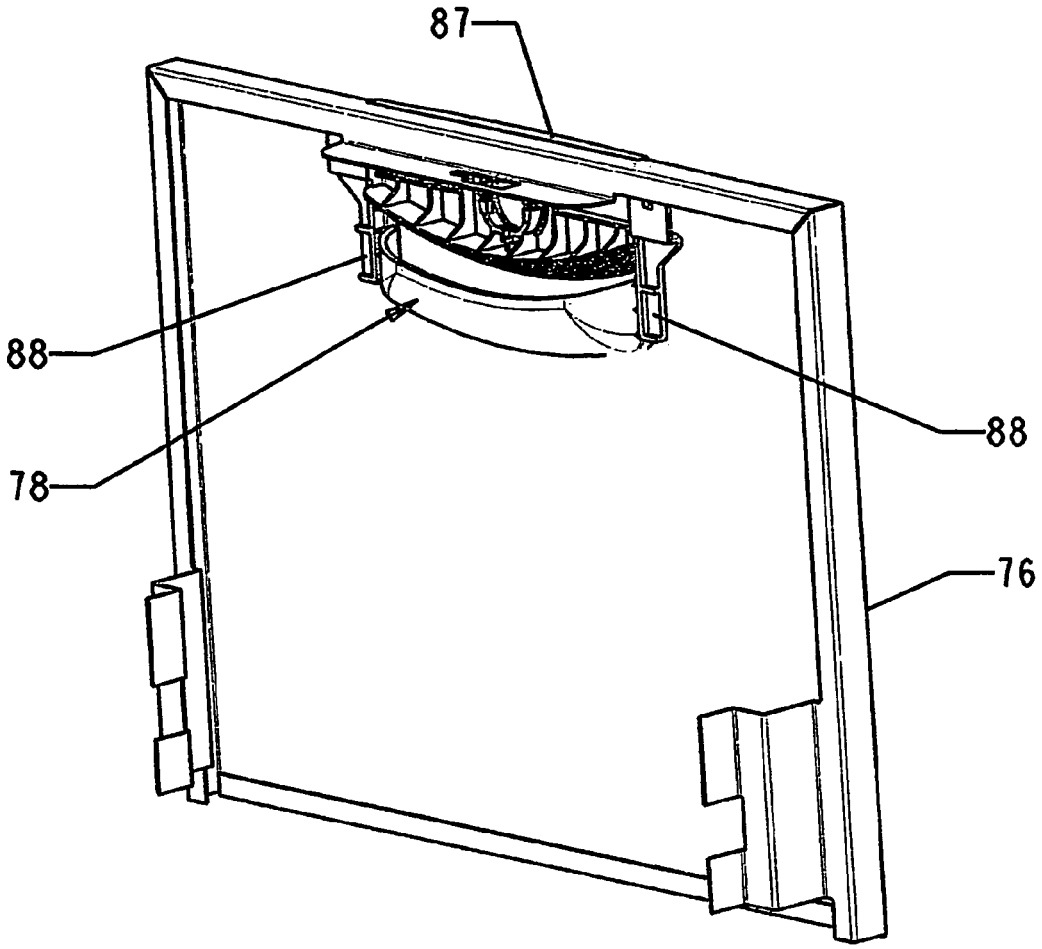
FIG. 20B is a rear perspective view similar to FIG. 20A with the escutcheon plate mounted in the drawer front.
Figure 20C:
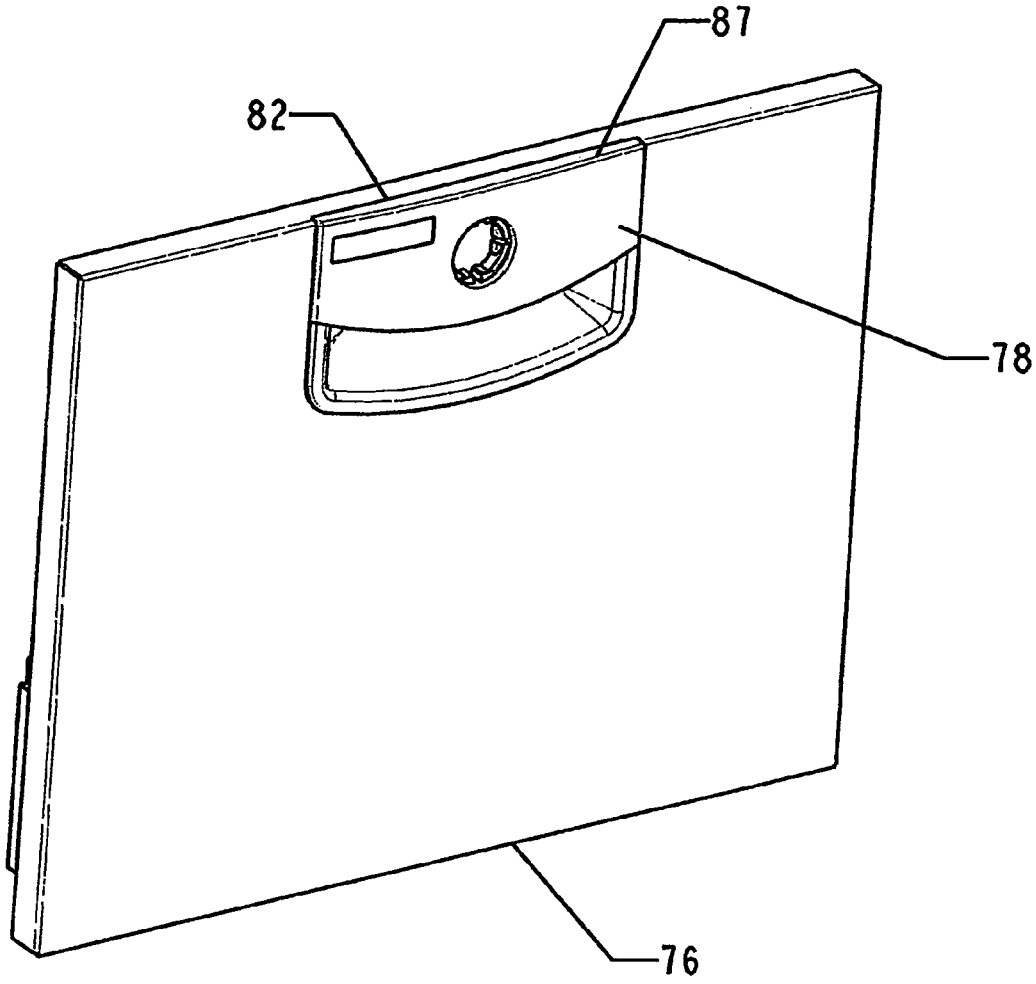
FIG. 20C is a front perspective view showing the escutcheon plate mounted to the drawer front.
Figure 23:
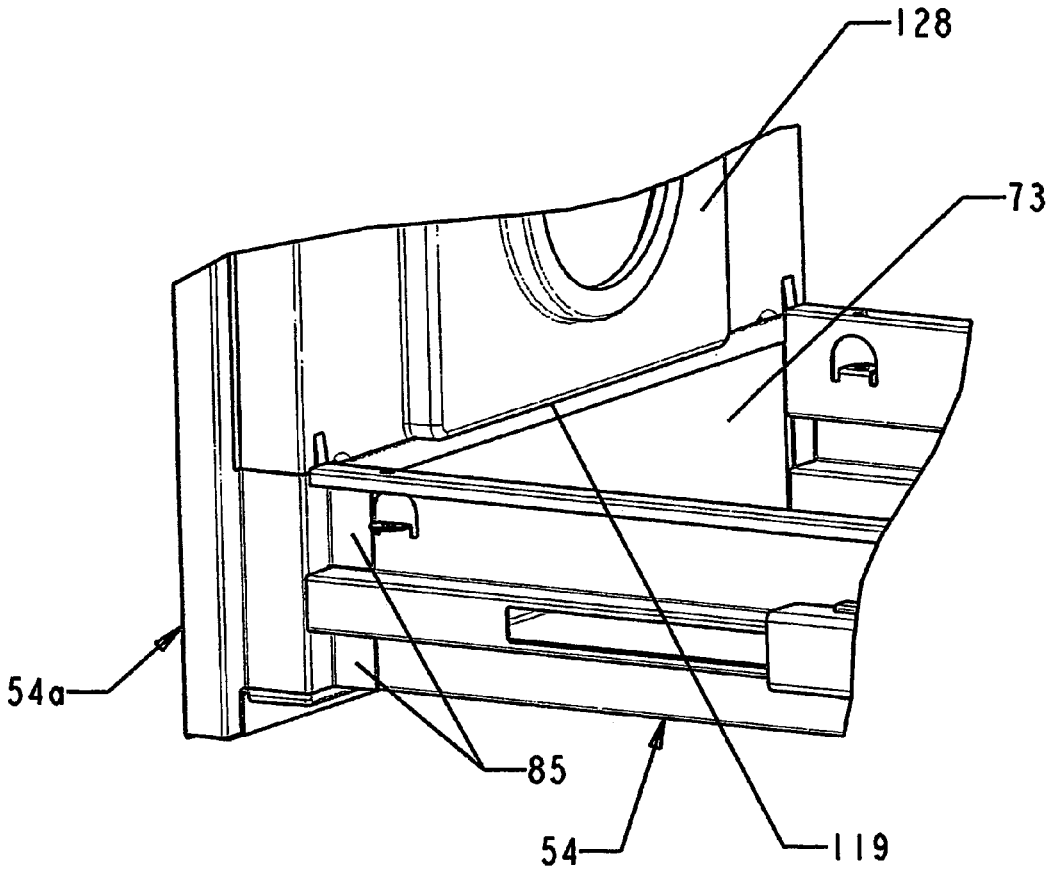
FIG. 23 is an enlarged partial perspective view of the drawer assembly shown in FIG. 9.

As best seen in FIGS. 9 and 16, the fully assembled front drawer assembly 54*a* may now be attached to the completed drawer frame 54. Specifically, with additional reference to FIG. 19, a rear protrusion 128 extends outwardly from the rear of drawer head 77 and includes a lower surface 119. Further, front section 73 of drawer frame 54 includes a top edge 120 and tab mounting surfaces 121. As best seen in FIGS. 16, 17 and 23, the front drawer assembly 54*a* is secured to drawer frame 54 by fixedly attaching tabs 85 to tab mounting surfaces 121 on the drawer frame 54 by any suitable method of attachment, such as, but not limited to, welding, adhesive or mechanical fasteners. With further reference to FIG. 19, top edge 120 of front section 73 of drawer frame 54 is coupled with lower surface 119 of protrusion 128 to securely hold drawer head 77 in place.

Figure 24:
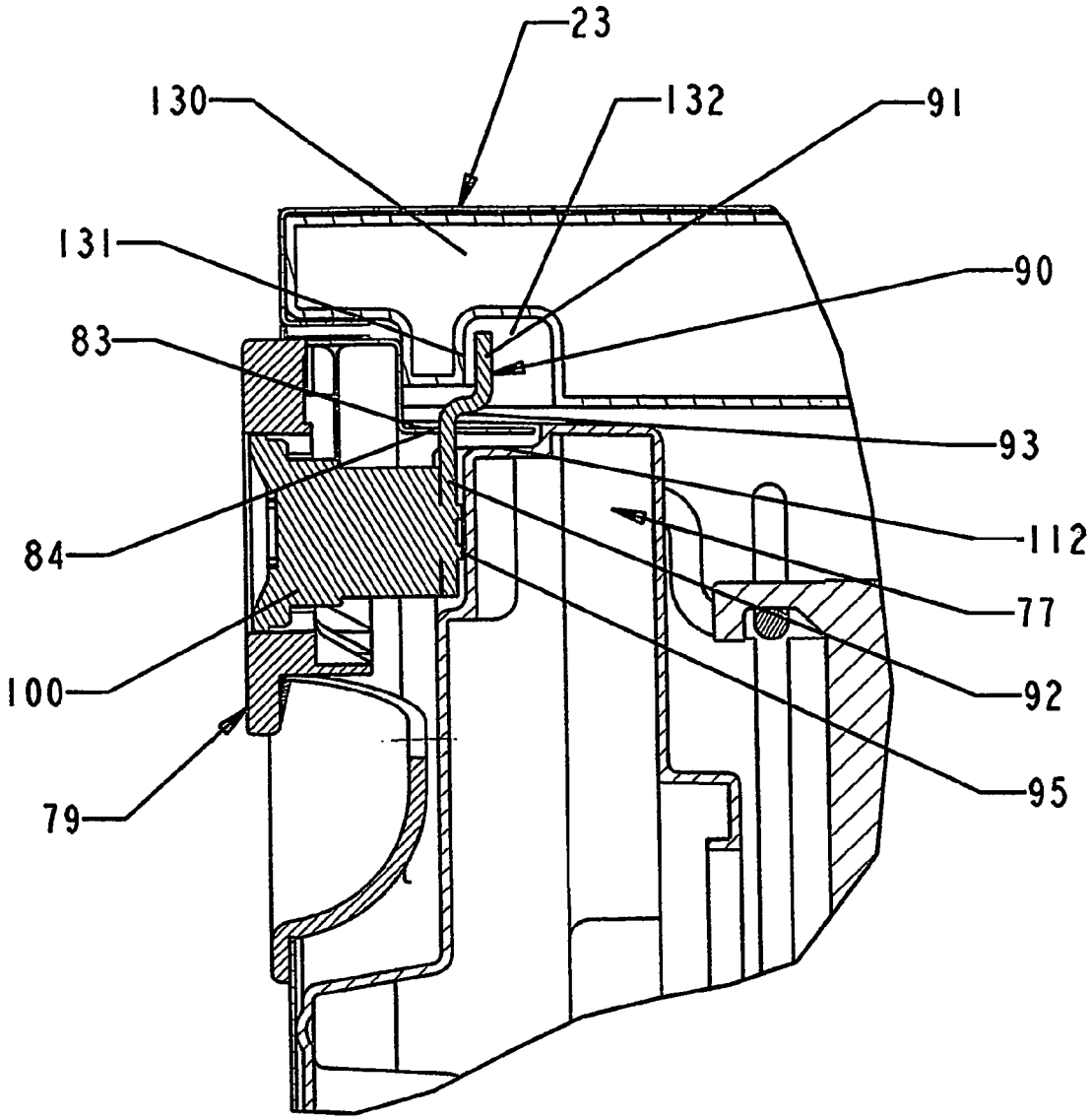
FIG. 24 is cross-sectional view taken along line 24-24 in FIG. 1 showing the locking mechanism in a locked position.

As best seen in FIGS. 22 and 24, the locking mechanism 79 is in the secure or locked position. Latching slot 84 of ledge 83 may be shaped to provide adequate clearance to allow cam 90 to rotate into the locked position. In operation, the drawer assembly 19 is locked when cam 90 is in the upright position as illustrated in FIG. 24. Attempting to open drawer assembly 19 while locking mechanism 79 is in a locked position will result in cam 90 contacting ledge 83, which will preclude the drawer from opening.

In the event that the file cabinet is subjected to fire or extreme heat, sheet metal elements, such as ledge 83, may become damaged and be unable to serve as a stop for the cam. In such an event, drawer assembly 19 of file cabinet 10 will remain secure. In particular, upon attempting to open the drawer assembly 19, ledge 112 (FIGS. 18 and 24) in drawer head 77 will serve as a rest for flat portion 93 of cam 90, and a front surface 131 adjacent to a recess 132 formed in a top wall 130 of interior casing 23 will contact locking leg 91 of cam 90.

The present invention overcomes and ameliorates the drawbacks and deficiencies in the prior art. Specifically, the multi-drawer file cabinet of the present invention provides fire-resistance and allows a plurality of file cabinets to be securely stacked upon one another without requiring additional fastening members. In addition, the present invention includes at least one rubber bumper or washer positioned between upper and lower file cabinets to prohibit the fastening members from damaging the top surface of the lower file cabinet. Furthermore, the present invention allows two stacked panels to fit under a standard size top.

The present invention also includes a unique full extension, inexpensive drawer assembly. At least one anti-scrape polymeric guide extrusion is located at the outer ends of the channels in order to reduce binding and scraping of the slide channels with other portions of the drawer assembly and the interior casing. The drawer assembly allows for easy installation and does not utilize rollers or bearings. To reduce assembly costs, the entire front drawer assembly can be assembled without tools or fasteners. Furthermore, the present invention includes a unique lock assembly that retains the drawer assembly in a locked position even if the drawer front or drawer assembly sustains fire damage.

Although the present invention has been described in considerable detail with reference to certain preferred versions thereof, other versions are possible. Therefore, the spirit and scope of the appended claims should not be limited to the description of the preferred versions contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A multi-drawer file cabinet comprising:

a first cabinet including a first upper shell portion having a top section and two downwardly extending side sections, a first rear shell portion coupled with the first upper shell portion, a first base coupled with the two side sections and the first rear shell portion to form a first shell assembly, a first interior casing positioned within the first shell assembly, and a first drawer assembly slidably coupled to the first interior casing, wherein the top section includes a top surface having a peripheral edge, the peripheral edge of the top surface having a first perimeter, and the first cabinet having a drawer opening defined by an edge; and a second cabinet including a second upper shell portion having a top section and two downwardly extending side sections, a second rear shell portion coupled with the second upper shell portion, a second base coupled with the two side sections and the second rear shell portion to form a second shell assembly, a second interior casing positioned within the second shell assembly, and a second drawer assembly slidably coupled to the second interior casing, the second base including a lower surface and a sidewall extending downwardly from the lower surface of the second base, the sidewall including a peripheral edge, the peripheral edge of the sidewall having a second perimeter, wherein the second perimeter is larger than the first perimeter, wherein the sidewall of the second base fits around the peripheral edge of the top surface of the first cabinet, and wherein the second base of the second cabinet is in contact with the top surface of the first cabinet.

2. The multi-drawer file cabinet as recited in claim 1, wherein the sidewall includes a top edge that is adjacent to the lower surface of the second base, wherein the distance between the top edge of the sidewall and the peripheral edge of the sidewall is equal to the distance between the peripheral edge of the top surface of the first cabinet and the edge of the drawer opening of the first interior casing.

3. The multi-drawer file cabinet as recited in claim 1, further comprising at least one bumper mounted to the lower surface of the second base.

4. The multi-drawer file cabinet as recited in claim 1, further comprising an accessory holder including a base, the accessory holder base having a sidewall with a peripheral edge, the peripheral edge of the accessory holder sidewall having a third perimeter, the top section of the second upper shell portion including a top surface having a peripheral edge, the peripheral edge of the top section of the second cabinet including a fourth perimeter, wherein the third perimeter is larger than the fourth perimeter so that the sidewall of the accessory holder fits around the peripheral edge of the top surface of the second cabinet.

5. The multi-drawer file cabinet as recited in claim 1, wherein at least one of the second upper shell portion and the second rear shell portion has at least one tab extending from a bottom edge thereof, and the second base having at least one slot defined therein for accepting the at least one tab.

6. The multi-drawer file cabinet as recited in claim 5, wherein each of the side sections of the second user shell portion have at least one tab extending from a bottom edge thereof, wherein each of the tabs extend generally inward toward the opposing side section of the second upper shell portion.

7. The multi-drawer file cabinet as recited in claim 5, wherein the at least one slot includes a fitted groove.

8. The multi-drawer file cabinet as recited in claim 7, wherein the at least one tab has a mounting hole defined therein, wherein the second base has a corresponding mounting hole defined therein, and wherein a fastening mechanism extends between the mounting holes to secure the second upper shell portion with the second base.

9. The multi-drawer file cabinet as recited in claim 1, wherein at least a portion of the first interior casing is formed of a non-flammable thermal insulating material.

10. The multi-drawer file cabinet as recited in claim 1, wherein the second base includes a top surface, wherein a lip extends from the top surface of the second base to engage a front side of the second interior casing.

11. The multi-drawer file cabinet as recited in claim 1, wherein at least one of the first drawer assembly and the second drawer assembly includes a front drawer assembly, a frame, and a pair of opposing slide members, wherein the front drawer assembly is coupled with the frame, and the opposing slide members are slidably coupled with the frame to allow the drawer assembly to move relative to the corresponding interior casing.

12. The multi-drawer file cabinet as recited in claim 11, wherein the opposing slide members are disposed between a pair of outer tracks formed in the corresponding interior casing and a pair of drawer tracks positioned on the frame.

13. The multi-drawer file cabinet as recited in claim 12, wherein the outer tracks formed in the corresponding interior casing each include an outer groove and an inner groove, wherein the inner groove is defined in the outer groove, and wherein at least one of the slide members have a stop extending therefrom that extends into the inner groove formed in the corresponding interior casing.

14. The multi-drawer file cabinet as recited in claim 11, wherein a pair of drawer tracks extend from the frame and have slots defined therein, and wherein each of the opposing slide members have slide tabs that extend into the slots formed in the drawer tracks.

15. The multi-drawer file cabinet as recited in claim 11, wherein the front drawer assembly includes a drawer head, an escutcheon plate, a drawer front, and a locking mechanism, wherein the drawer head and the escutcheon plate are coupled with the drawer front, and the locking mechanism is positioned within the escutcheon plate.

16. The multi-drawer file cabinet as recited in claim 15, wherein the locking mechanism includes a cam, and wherein the drawer front has a latching slot formed therein for receiving the cam.

17. The multi-drawer file cabinet as recited in claim 16, wherein the cam includes an attaching leg, a flat portion, and a locking leg.

18. The multi-drawer file cabinet as recited in claim 17, wherein the drawer head includes a ledge positioned below at least a portion of the flat portion of the cam, and wherein the corresponding interior casing has a recess formed therein for receiving the locking leg of the cam.

19. The multi-drawer file cabinet as recited in claim 18, wherein the recess formed in the corresponding interior casing is configured to receive the locking leg when the flat portion of the cam is in contact with the ledge.

20. The multi-drawer file cabinet as recited in claim 17, wherein the attaching leg and the locking leg are generally parallel with one another, and wherein each of the attaching leg and the locking leg are positioned at an angle relative to the flat portion.

21. The multi-drawer file cabinet as recited in claim 1, wherein the sidewall does not contact the top surface of the first cabinet.

22. A multi-drawer file cabinet comprising:

a first cabinet including a top surface having a peripheral edge, the peripheral edge of the top surface having a first perimeter, the first cabinet having a drawer opening defined by an edge; and a second cabinet including a base, the base having a sidewall with a peripheral edge, the peripheral edge of the sidewall having a second perimeter, wherein the second perimeter is larger than the first perimeter, wherein the sidewall of the second cabinet fits around the peripheral edge of the top surface of the first cabinet so that the second cabinet is positioned on top of the first cabinet, wherein at least one of the first and second cabinets further includes an interior casing, an upper shell portion, a rear shell portion, and a drawer assembly, wherein the drawer assembly includes a front drawer assembly, a frame, and a pair of opposing slide members, wherein the front drawer assembly is coupled with the frame, wherein the opposing slide members are slidably coupled with the frame to allow the drawer assembly to move relative to the interior casing, wherein a pair of drawer tracks extend from the frame and have slots defined therein, wherein each of the opposing slide members have slide tabs that extend into the slots formed in the drawer tracks, and wherein at least one of the slide tabs has a lock slot formed therein, the drawer assembly further comprising at least one clip having a locking tab extending therefrom, wherein the locking tab is positioned within the lock slot.

23. The multi-drawer file cabinet as recited in claim 22, further comprising an extrusion coupled with at least one of the slide members.

* * * * *